US009182185B2

(12) United States Patent
Hatch

(10) Patent No.: US 9,182,185 B2
(45) Date of Patent: Nov. 10, 2015

(54) APPARATUS FOR LOADING CARTRIDGES INTO A FIREARM MAGAZINE

(71) Applicant: Larry P. Hatch, Tucson, AZ (US)

(72) Inventor: Larry P. Hatch, Tucson, AZ (US)

( * ) Notice: Subject to any disclaimer, the term of this patent is extended or adjusted under 35 U.S.C. 154(b) by 75 days.

(21) Appl. No.: 14/088,117

(22) Filed: Nov. 22, 2013

(65) Prior Publication Data

US 2014/0373421 A1 Dec. 25, 2014

Related U.S. Application Data

(60) Provisional application No. 61/729,407, filed on Nov. 22, 2012.

(51) Int. Cl.

| | |
|---|---|
| ***F41A 9/61*** | (2006.01) |
| ***F41A 9/83*** | (2006.01) |
| ***F41A 9/82*** | (2006.01) |
| ***F41A 9/67*** | (2006.01) |

(52) U.S. Cl.
CPC ... *F41A 9/83* (2013.01); *F41A 9/67* (2013.01); *F41A 9/82* (2013.01)

(58) Field of Classification Search
CPC ..... F41A 9/82; F41A 9/83
USPC ..... 42/87; 89/33.1
See application file for complete search history.

(56) References Cited

U.S. PATENT DOCUMENTS

| | | | | |
|---|---|---|---|---|
| 4,739,572 | A * | 4/1988 | Brandenburg | 42/87 |
| 4,939,862 | A * | 7/1990 | Brandenburg et al. | 42/88 |
| 4,949,495 | A * | 8/1990 | Mari | 42/87 |
| 5,301,449 | A * | 4/1994 | Jackson | 42/87 |
| 6,754,987 | B1 | 6/2004 | Cheng et al. | |
| 2009/0044440 | A1 | 2/2009 | Tal et al. | |
| 2012/0192477 | A1 | 8/2012 | Kim | |
| 2012/0222343 | A1 | 9/2012 | Kim | |
| 2012/0255211 | A1 | 10/2012 | Kim | |
| 2014/0109451 | A1 * | 4/2014 | Beckman | 42/1.02 |

OTHER PUBLICATIONS

PCT/US2013/071521—International Preliminary Report on Patentability mailed Jun. 4, 2015.
PCT/US2013/071521—International Search Report and Written Opinion dated Mar. 26, 2014.

* cited by examiner

*Primary Examiner* — J. Woodrow Eldred
(74) *Attorney, Agent, or Firm* — Dale F. Regelman; Quarles & Brady LLP

(57) ABSTRACT

An apparatus for loading cartridges into a firearm magazine, including a funnel portion for intake of one or more cartridges, a guide box attached to the funnel portion, a cassette attached to the guide box, a slider attached to the cassette, and a magazine attached to the slider.

20 Claims, 25 Drawing Sheets

APPARATUS FOR LOADING CARTRIDGES INTO A FIREARM MAGAZINE

CROSS-REFERENCE TO RELATED APPLICATIONS

This application claims priority to a U.S. Provisional Application having Ser. No. 61/729,407, filed on Nov. 22, 2012, which is hereby incorporated by reference herein.

FIELD OF THE INVENTION

The present invention is directed to a firearm magazine loading system.

BACKGROUND OF THE INVENTION

The present invention is in the technical field of firearms. More particularly, the present invention is in the technical field of loading devices for firearms that have a detachable magazine.

Conventional loading of detachable firearm magazines, sometimes incorrectly referred to as clips often require strength, dexterity, or both. It is often difficult to load more than a few magazines at a time by hand, because it often leads to sore fingers. Even currently available magazine "speed" loaders often require dexterity to line up the cartridges one by one in a machine, to then have to force the cartridges into the magazine by either pushing directly down, pulling on a handle to force the cartridges into the magazine, or to insert each cartridge into a finger operated machine one at a time to use leverage to help force them into the magazine. It is often a time consuming and tiring event to line up and then force the cartridges into the magazine either by hand or with mechanical advantage. Often this leads to many people who may suffer from strength or dexterity issues from being able to enjoy the sport of shooting. Further even able-bodied people may avoid this recreational activity due to the time and hassle that is required to load enough removable magazines to make the experience worthwhile.

SUMMARY OF THE INVENTION

Applicant's apparatus includes a funnel-like upper portion which can be used for multiple calibers of cartridges, a cassette which attaches to specific caliber magazines and to the funnel, a slider for controlling the follow of cartridges into a magazine, and an attachment to the bottom of conventional magazines comprising a motor and associated parts that retract a spring and carrier plate of the magazine to allow the cartridges to load into the magazine. In certain embodiments, Applicant's apparatus further comprises a stand to hold the entire assembly in a vertical position.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF PREFERRED EMBODIMENTS

Figure 1A:
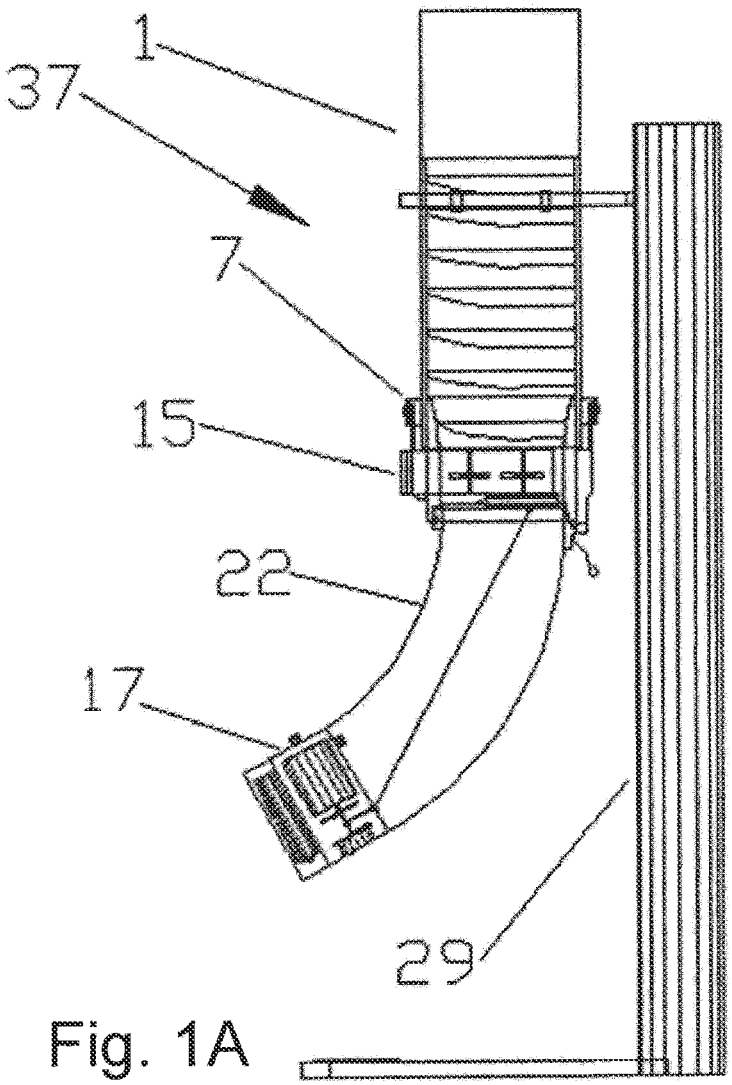
FIG. 1A is a side view of the present invention.

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow charts included are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Referring now to FIGS. 1A, 1B, 1C, and 2, Applicant's magazine loading device 37 comprises a funnel 1 for firearm cartridges having a straight box shaped portion that conveys cartridges in a serpentine pattern to lower portions of Applicant's apparatus. The funnel 1 is configured such that multiple calibers of cartridges can be used. The funnel 1 is held in a substantially level orientation, optionally elevated by a stand 29.

A funnel 1 is attached to cassette 7. Cassette 7 interconnects funnel 1 and in between the funnel 1 and a magazine 22.

Cassette 7 is configured to attach to a specific type and caliber of magazine. This being the case, separate embodiments of cassette 7 are required to use with differing calibers and magazine styles. Slider 15 is attached to cassette 7. Slider 15 allows cartridges to either drop from cassette 7 into a magazine 22, or stay suspended within the cassette 7.

Magazine 22 is a standard pre-existing firearm magazine (tension springs are not shown to allow for clarity), with the addition of a motor and retracting assembly 17.

In certain embodiments, magazine-loading device 37 is formed from wood, an engineering thermoplastic, metal, and combinations thereof. Further, in certain embodiments the various components of the magazine-loading device 37 can be made from different materials.

Figure 1B:
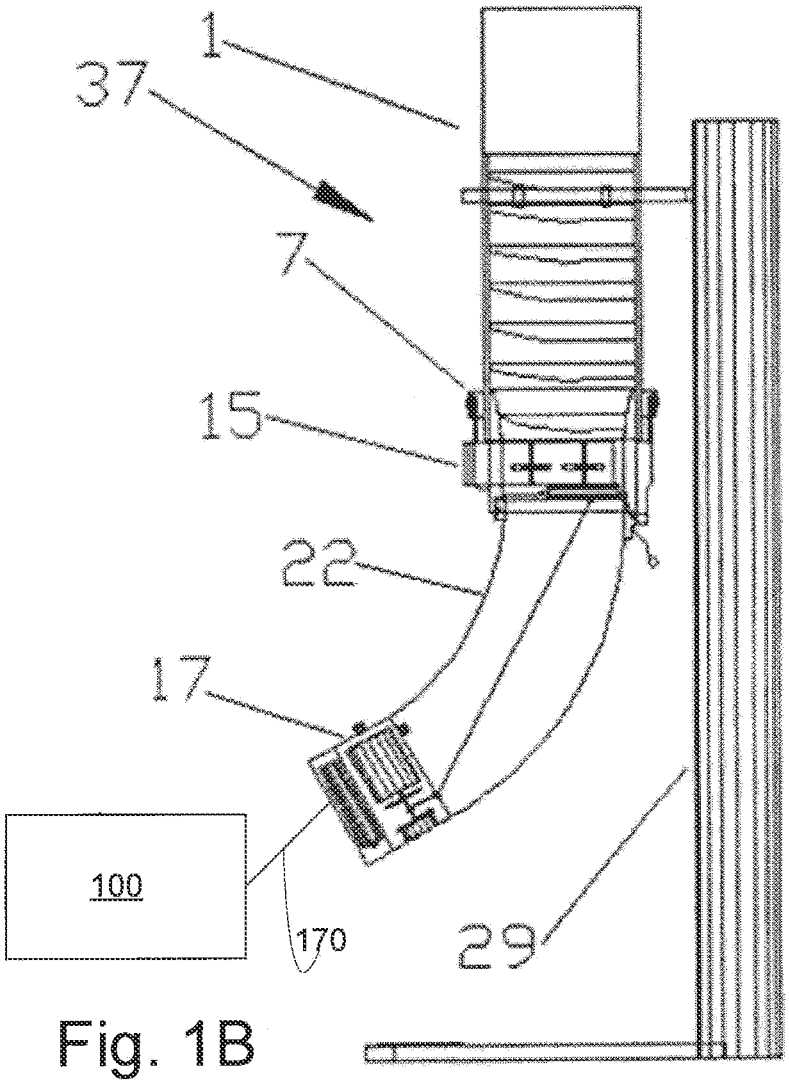
FIG. 1B shows a second embodiments of Applicant's apparatus further comprising a controller.

Referring now to FIG. 1B, according to an embodiment of the present invention, the magazine loading device 37 includes a controller 100 to implement controlled automation of the invention. The controller 100 is shown in further detail in FIG. 1C.

Motor assembly 17 is interconnected with controller 100 by communication link 170.

Figure 1C:
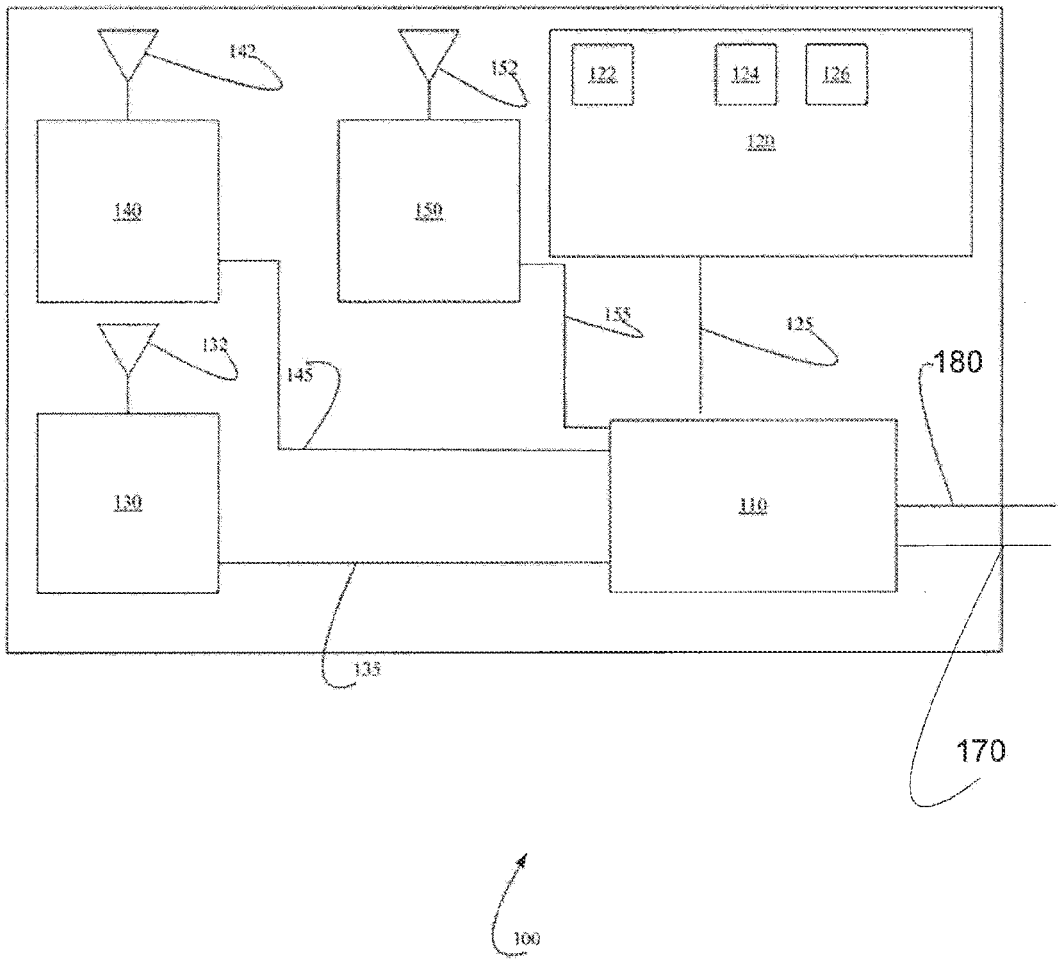
FIG. 1C illustrates Applicant's controller.

Referring now to FIG. 1C, controller 100 comprises processor 110, non-transitory computer readable medium 120 interconnected with processor 110 via communication link 125, optional Blue Tooth module 130 interconnected with processor 110 via communication link 135, optional RFID module 140 interconnected with processor 110 via communication link 145, and optional "WI-FI" module 150 interconnected with processor 110 via communication link 155.

In the illustrated embodiment of FIG. 1C, microcode 122, instructions 124, and database 126, are encoded in non-transitory computer readable medium 120. In certain embodiments, non-transitory computer readable medium 120 comprises non-volatile memory. In certain embodiments, non-transitory computer readable medium 120 comprises battery backed up RAM, a magnetic hard disk assembly, an optical disk assembly, and/or electronic memory. By "electronic memory," Applicant mean a PROM, EPROM, EEPROM, SMARTMEDIA, FLASHMEDIA, and the like.

Processor 110 uses microcode 122 to operate controller 100. Processor 110 uses microcode 122, instructions 124, and database 126, to operate Blue Tooth module 130, RFID module 140, and WI-FI module 150.

Processor 110 is interconnected with motor assembly 17 by communication link 170. Processor 110 is interconnected with motor 210 is Applicant's sorting assembly 200 by communication link 180.

Figure 1D:
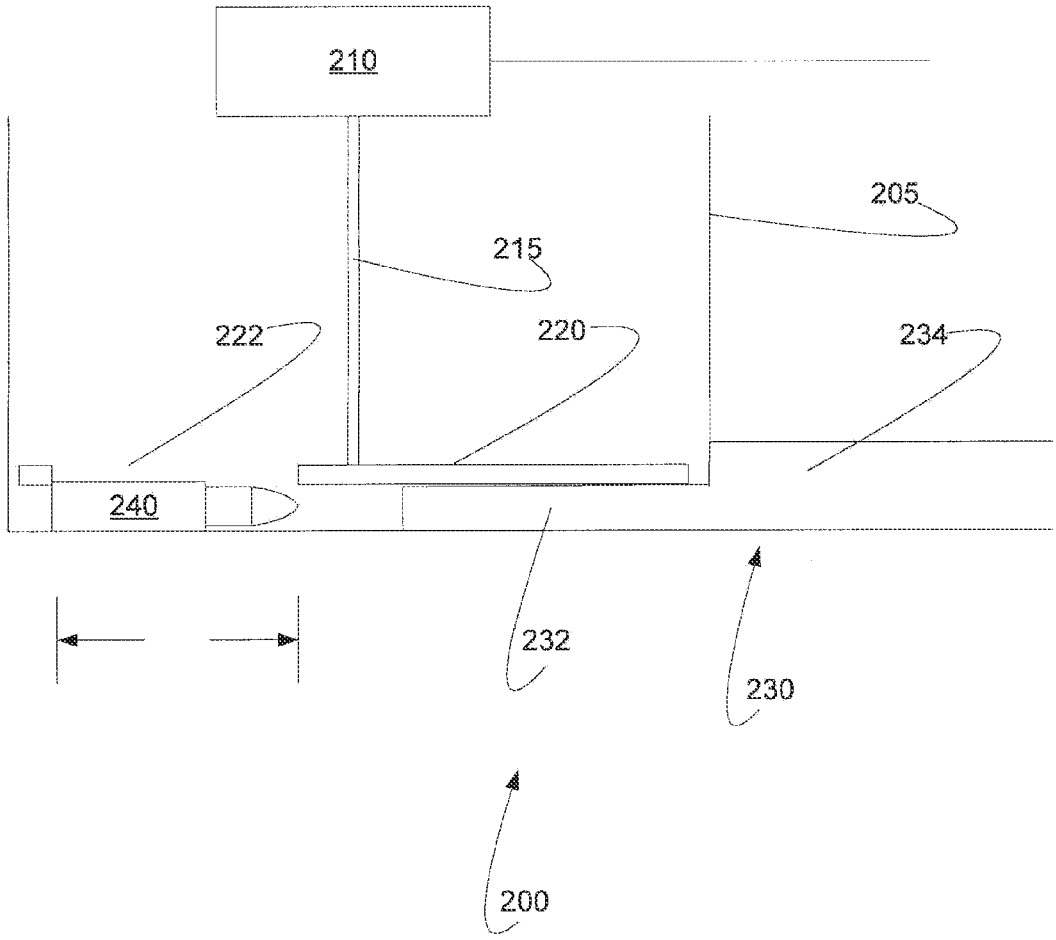
FIG. 1D shows a cross-section view of Applicant's sorting assembly 200.

Referring now to FIG. 1D, in certain embodiments Applicant's magazine loading device 37 further comprises cartridge sorting assembly 200. Sorting assembly 200 comprises a bowl-shaped housing 205 having an open top. Rotatable platen 220 is disposed within housing 205. Motor 210 rotates shaft 215 which is interconnected to rotatable platen 220. A discharge chute 230 extends outwardly from housing 205. Portion 232 of chute 230 comprises a U-shaped structure. Portion 234 of chute 230 comprises a tubular structure. The distal end 236 of chute 230 is positioned such that cartridges propelled outwardly from chute 230 are deposited into a top portion of funnel 1.

Figure 1E:
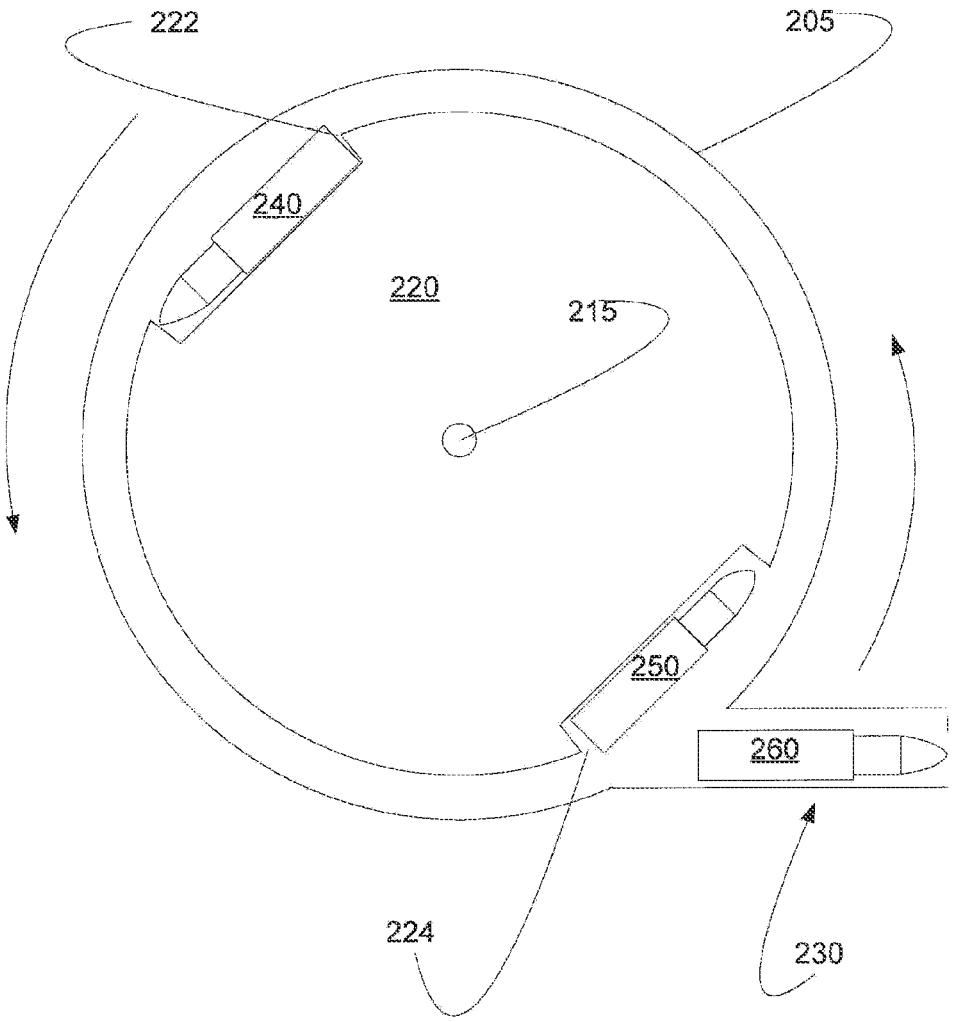
FIG. 1E is a top view of the sorting assembly of FIG. 1D.
Figure 2:
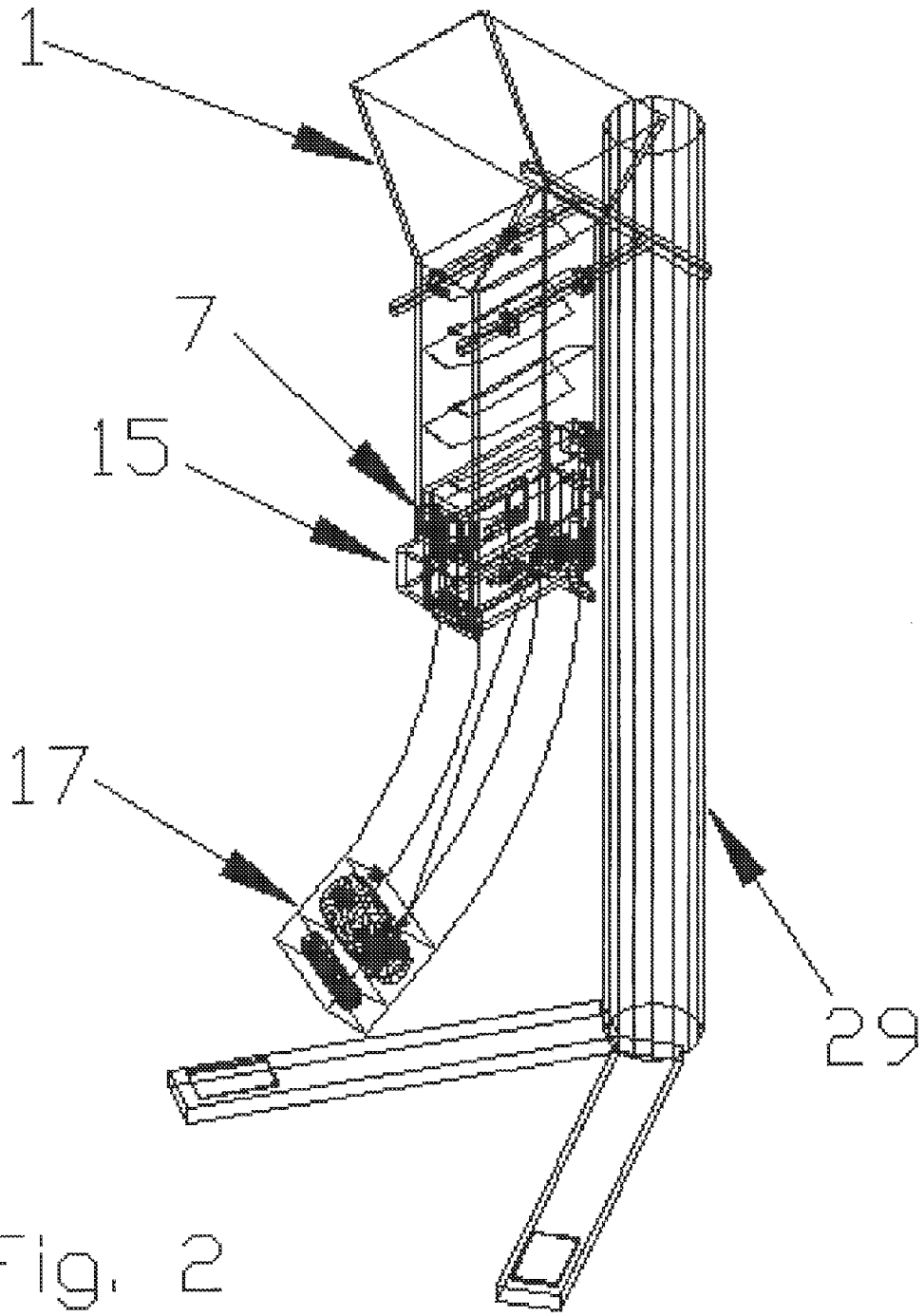
FIG. 2 is a perspective view of Applicant's apparatus.

Referring to FIG. 1E, rotatable platen is formed to include slots extending therethrough. In the illustrated embodiment of FIG. 1E, cartridge 240 is disposed within slot 222 and cartridge 250 is disposed within slot 224. As motor 210, via shaft 215, rotates platen 220, cartridges disposed in the slots in platen 220 are conveyed out of sorting assembly 200 and into chute 230. The dimensions of slots 222 and 224 are configured to accept only a specified cartridge type. Cartridges having larger dimensions cannot fall into slots 222 and 224, and therefore, do not enter into Applicant's magazine loading device 37. FIG. 1E shows two slots formed in rotatable platen 220. FIG. 1E should not be taken as limiting. In other embodiments, platen 220 is formed to include more than two cartridge slots.

Figure 3:
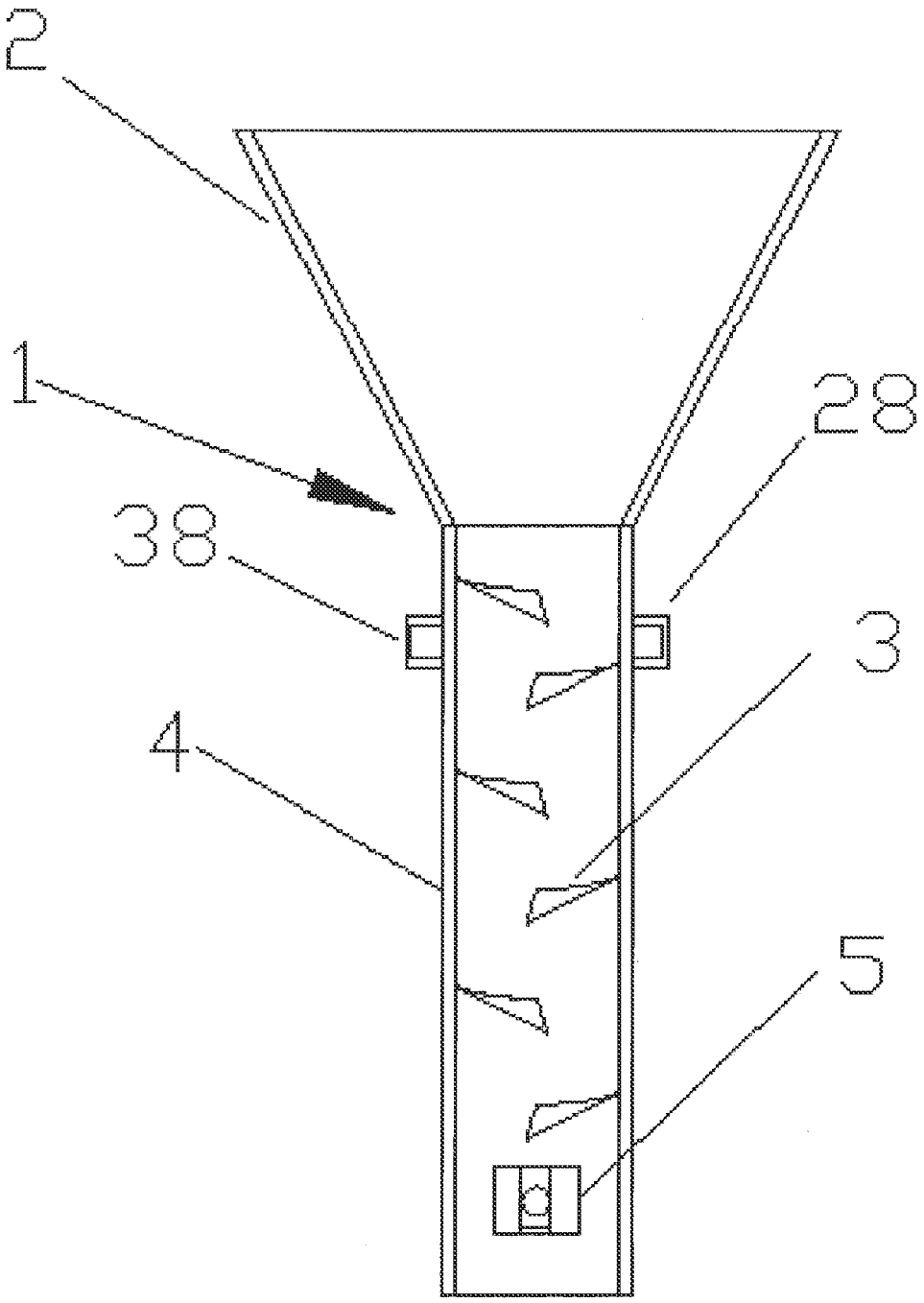
FIG. 3 is a front view of Applicant's funnel portion.
Figure 4:
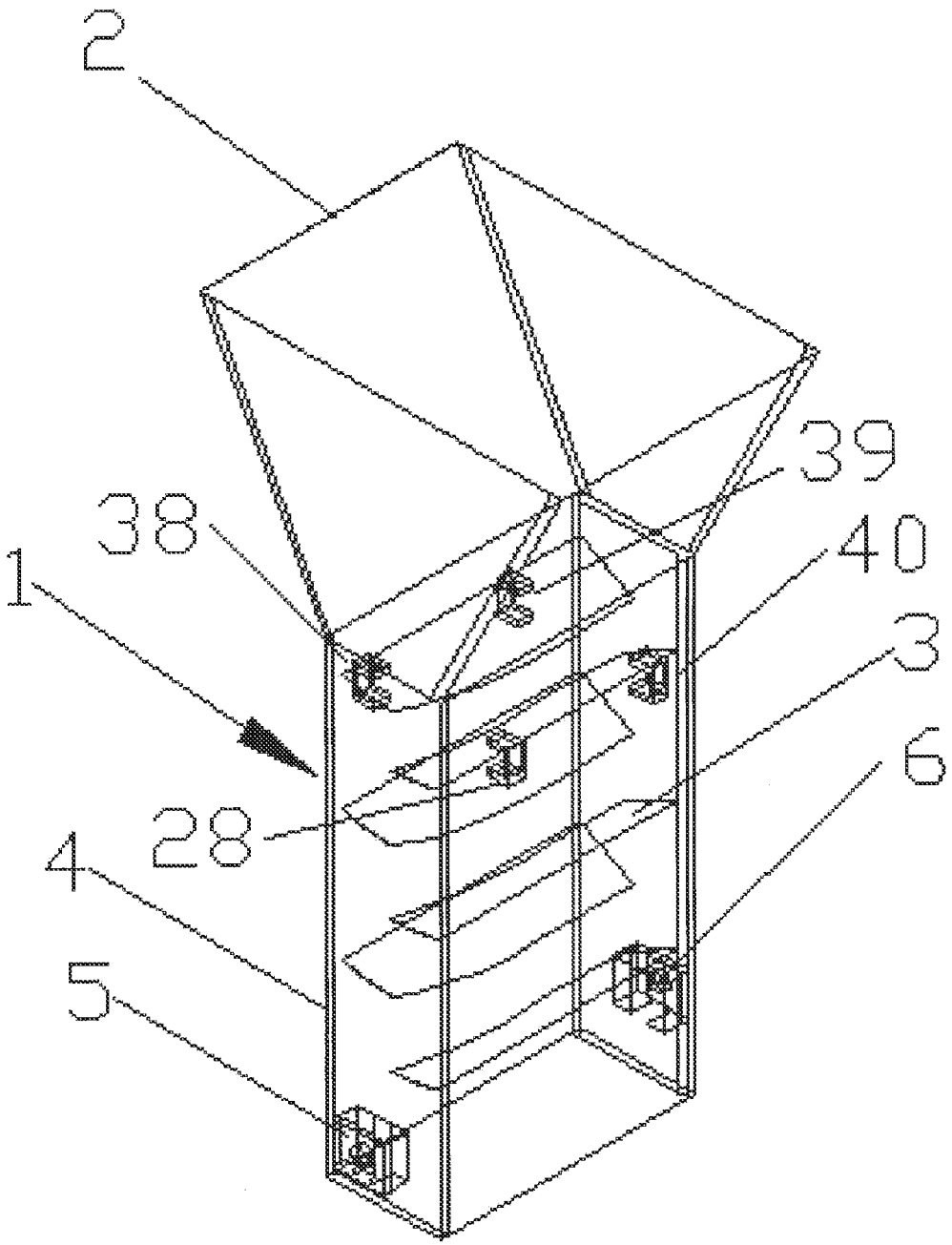
FIG. 4 is a perspective view of the funnel portion of FIG. 3.

Referring now to FIG. 3 and FIG. 4, there is shown funnel 1 having a tapered top 2, which allows for firearms cartridges to be guided down into a guide box 4. Within the guide box 4 are a plurality of fins 3 which guide the cartridges in a serpentine pattern direction due to the force of gravity.

Fins 3 are configured in an alternating pattern, and are constructed such that they are attached to the inside of the guide box 4 at an angle that allows velocity of the falling cartridges to be slowed, and also for the cartridges to move through the guide box without interruption or blockage. In certain embodiments, fins 3 are also smoothly tapered upward towards the front side of the guide box 4 to keep the cartridges in a horizontal position, and to stop them from going into a vertical position due to the nose of the cartridges being substantially heavier than the cartridge casings.

Figure 15:
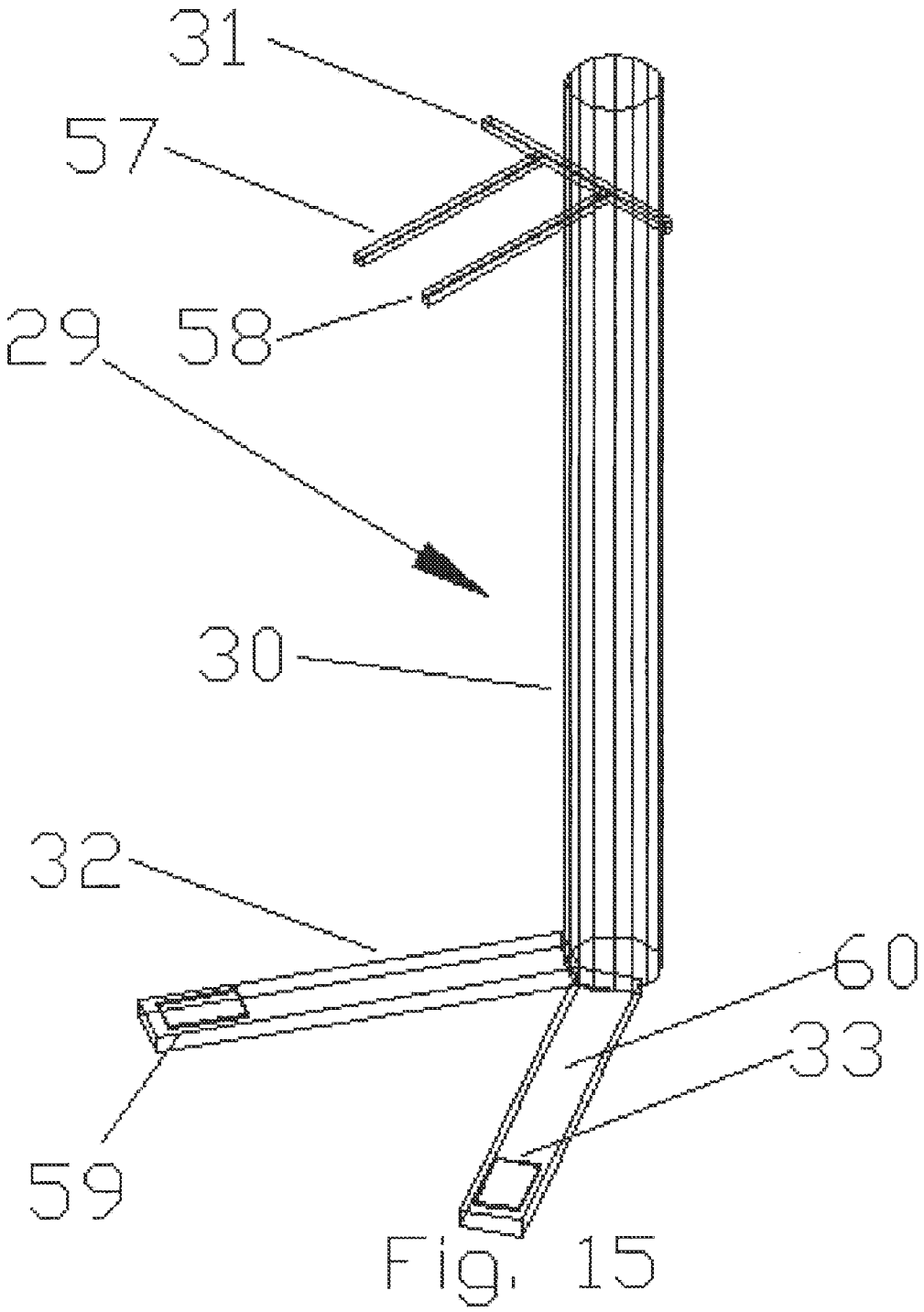
FIG. 15 is a perspective view of Applicant's stand portion.

Funnel 1 is attached to and kept in a substantially vertical position by the stand 29 with the use of connectors 28, 38, 39, 40, which slide onto the adjustable arms 57, 58 shown in FIG. 15 of the stand 29. Funnel 1 comprises connectors 5 and 6 which are used to attach the cassette 7. In certain embodiments, the connectors 5 and 6 are square shaped with a hole in the middle and the bottom portion is open, with a tapered ramp, to allow the attachment pieces 9 (FIG. 5) and 41 (FIGS. 5, 6) on the cassette 7 to slide into the hole in the middle of the connectors 5 and 6.

Figure 5:
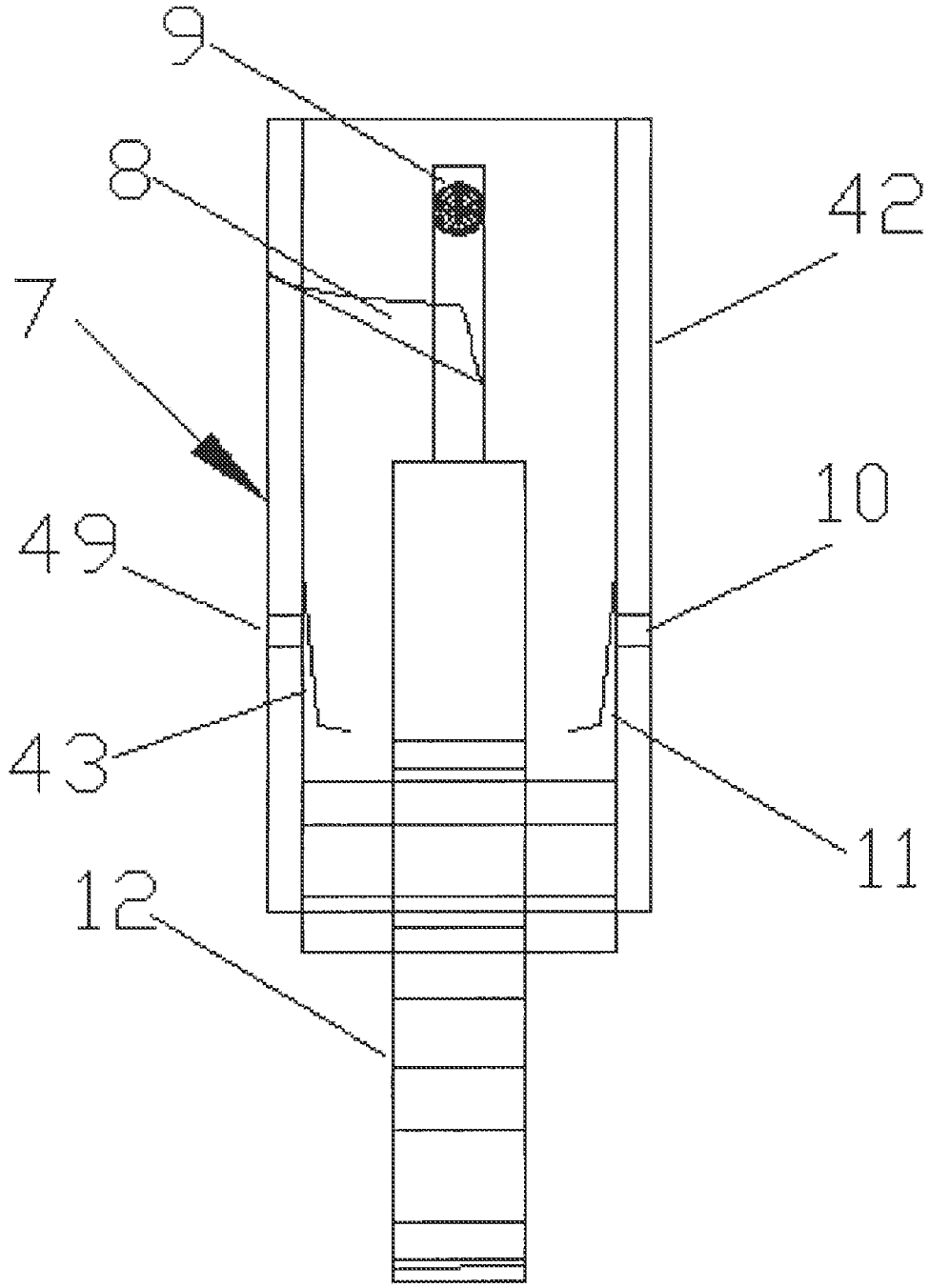
FIG. 5 is a front view of Applicant's cassette portion.
Figure 6:
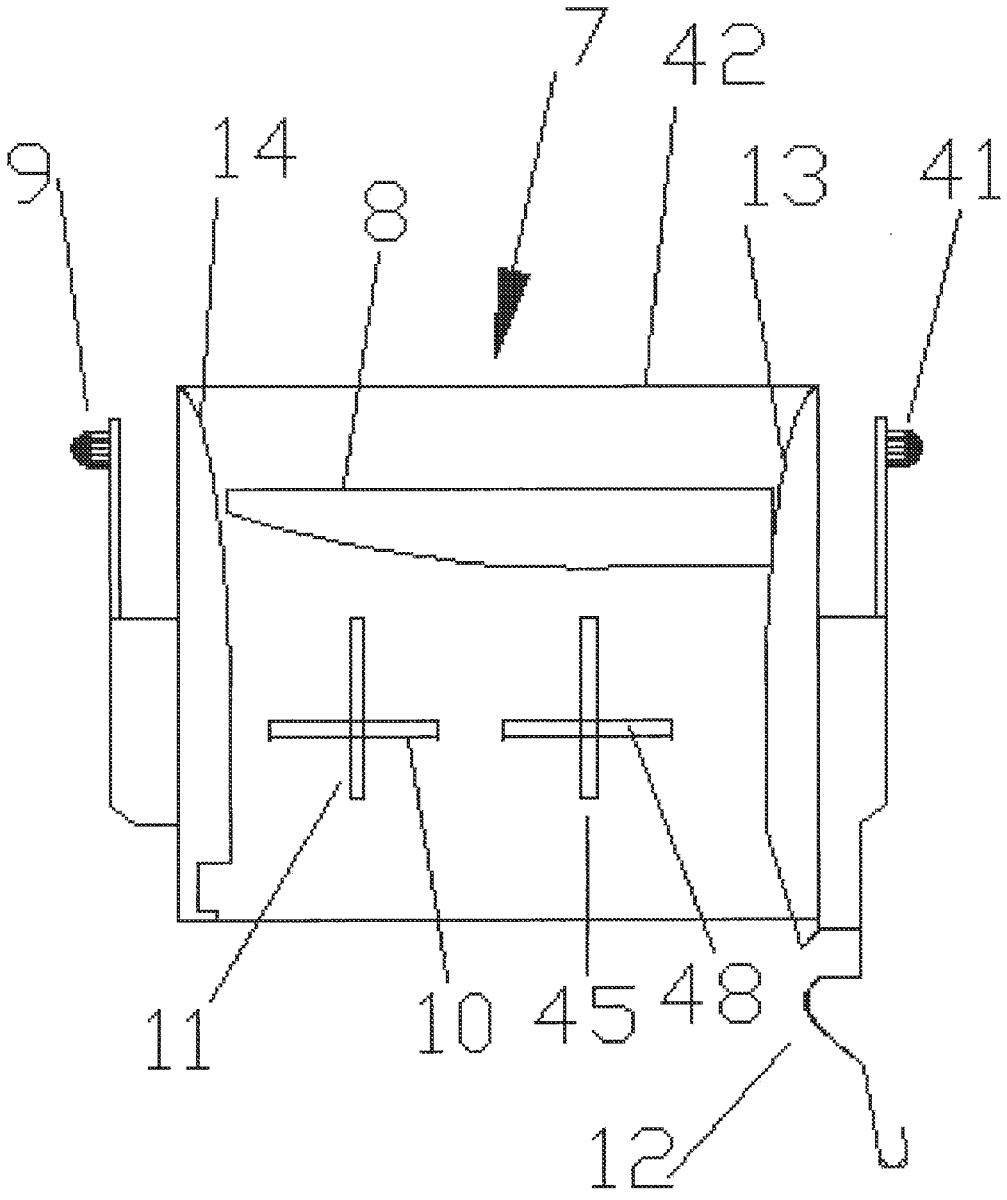
FIG. 6 is a side view of the cassette portion of FIG. 5.
Figure 7:
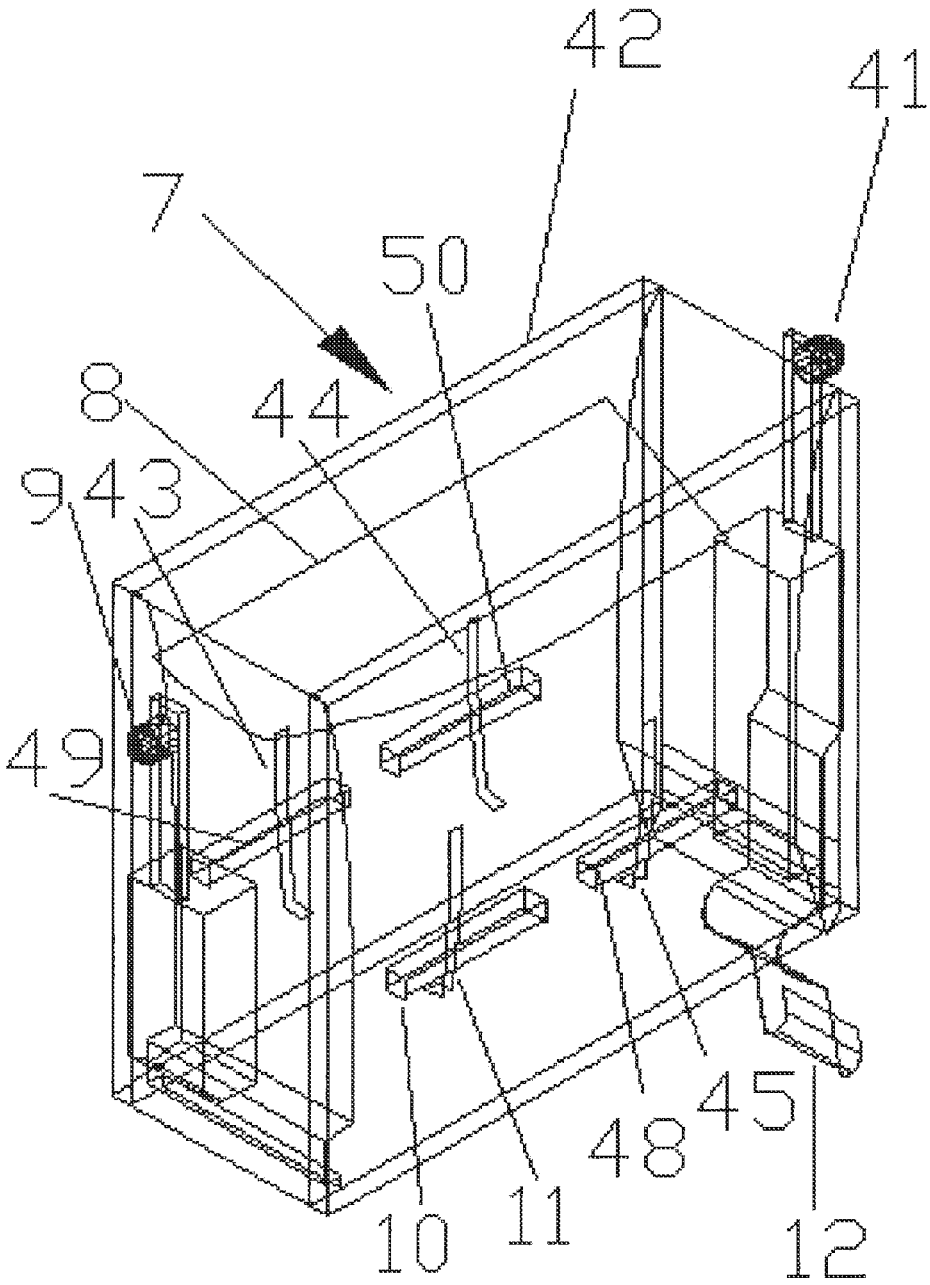
FIG. 7 is a perspective view of the cassette portion of FIG. 5.
Figure 16:
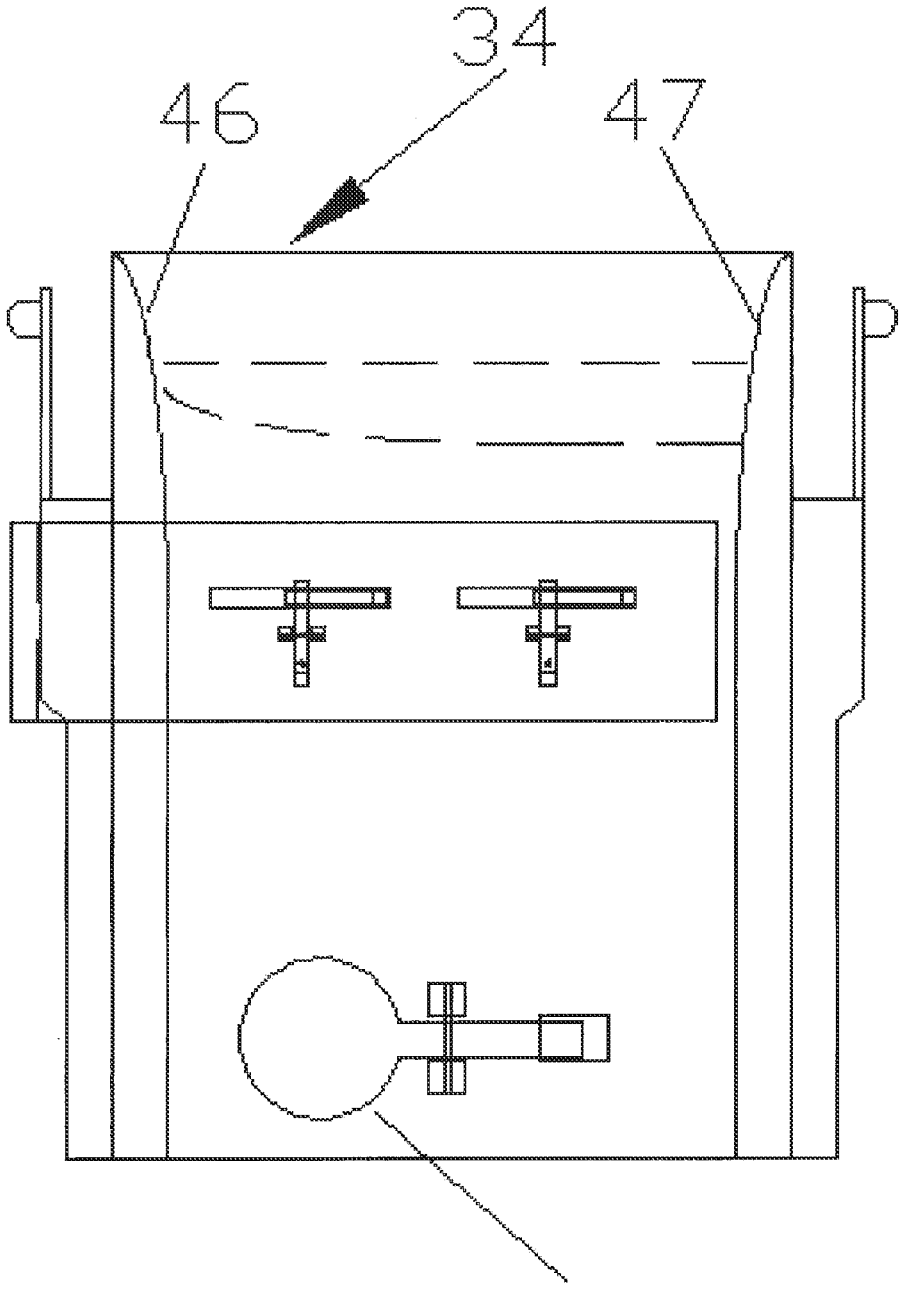
FIG. 16 is a side view of an alternate cassette portion.

Referring now to FIGS. 5, 6, and 7, the illustrated cassette 7 portion of the magazine-loading device 37 is based upon the AK47 format of magazine connection and loading. In other embodiments, cassette 7 portion can be designed to accommodate any style of magazine. FIG. 16 is an example of a cassette 34, modified to fit an M16 or AR15 style magazine.

Cassette 7 portion of the magazine-loading apparatus 37 comprises a main body 42 comprising a rectangular box with the top and bottom open forming a channel through the main body 42 which the firearm cartridges can progress through. Inside of the main body 42 is a fin 8, which acts in the same way as the fin 3 in FIG. 3, the only difference being that the fin 8 is usually smaller and shorter to allow it to fit into the main body 42 and to allow the cartridges to be put into a final position before entering the magazine 22.

Furthermore, inside of the channel in the main body 42, are four cartridge retainers 11, 43, 44, 45. In certain embodiments, cartridge retainers 11, 43, 44, 45 are made of spring steel, and are attached to the walls of the main body 42 only at the top of the cartridge retainers 11, 43, 44, 45. In certain embodiments, the spring steel is tensioned such that cartridge retainers 11, 43, 44, 45, are aligned in a vertical position, with the exception of the V shaped turn up at the bottom end. The functioning of the cartridge retainers 11, 43, 44, 45 is described hereinbelow.

Figure 17:
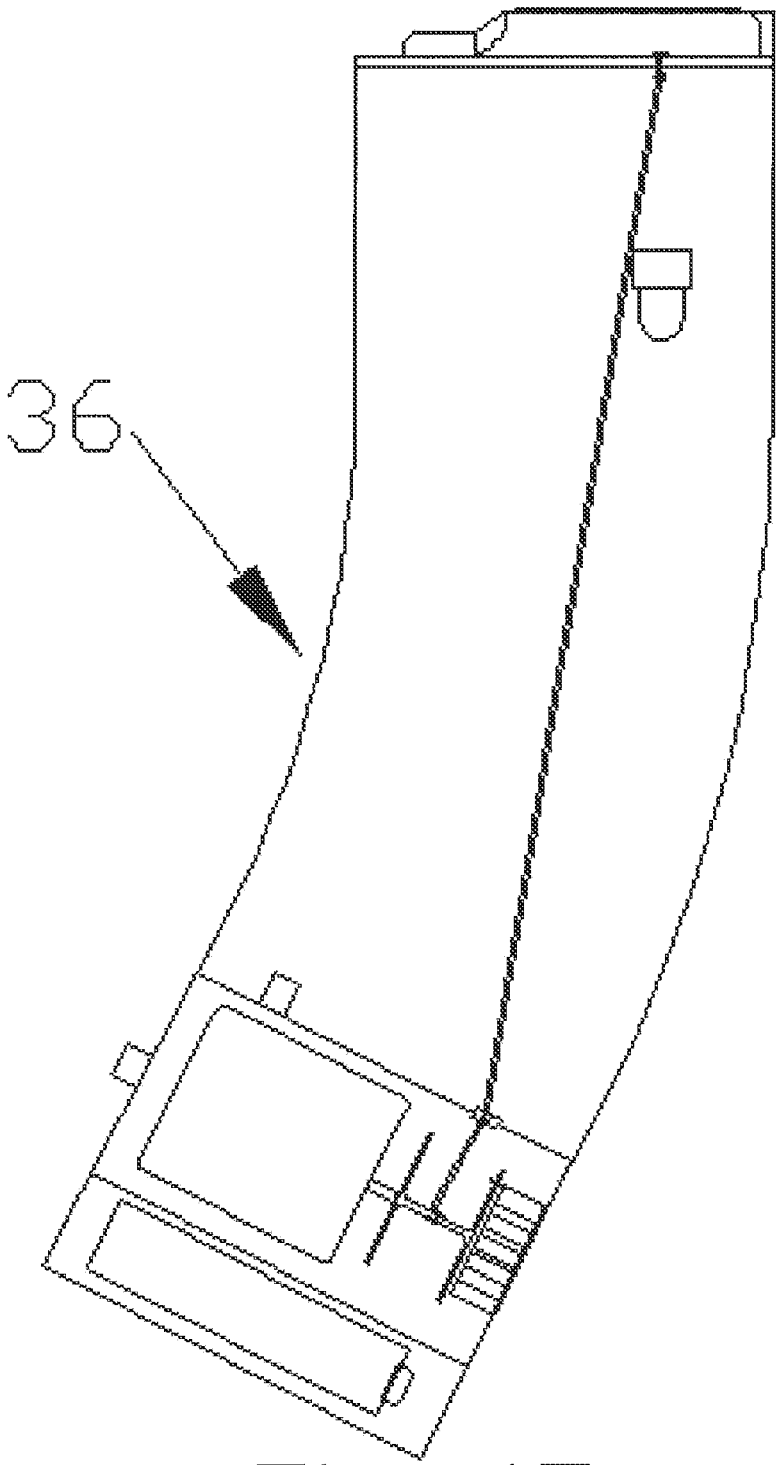
FIG. 17 is a side view of another caliber magazine portion.

Cartridges are further guided into their final position through the use of smoothly tapered shims 13 and 14, which are attached to the front and back of the channel through the main body 42. The profiles of shims 13 and 14 can be optimized to guide different caliber cartridges into position. In certain embodiments, additional shims (not incorporated in the drawings) are placed on the left and right side of the channel with the same properties as the shims 13 and 14. In certain embodiments, shims 13 and 14 can be modified to allow attachment of different types of magazines. As shown in FIGS. 5, 6, and 7, cassette 7 is configured to accept an AK47 style magazine 22. In the embodiment of FIG. 16, the cassette 34 has no modification to the bottom of the shims 46 and 47 and is configured to accept an M16 style magazine 36 shown in FIG. 17.

Figure 8:
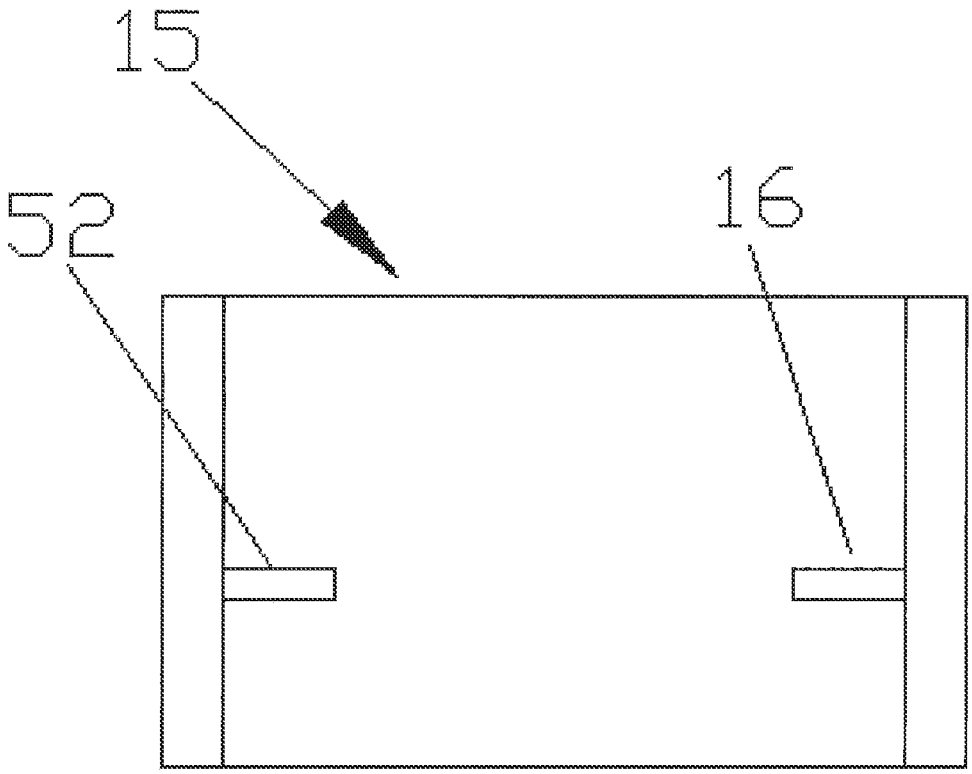
FIG. 8 is a front view of Applicant's slider portion.
Figure 9:
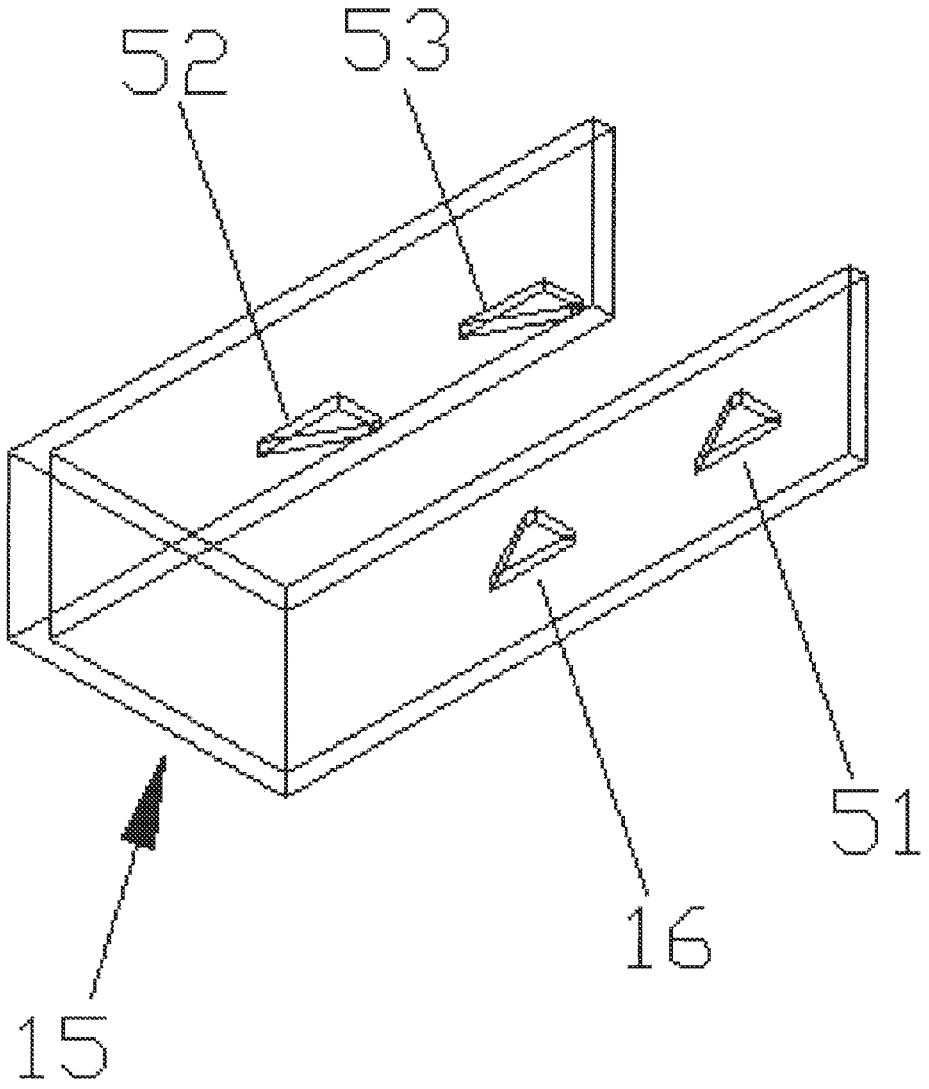
FIG. 9 is a perspective view of the slider portion of FIG. 8.

Referring again FIGS. 5, 6, and 7, four slits 10, 48, 49, and 50 are formed into the sides of the main body 42, and are oriented perpendicular to the cartridge retainers 11, 43, 44, and 45, respectively, with the cartridge retainers 11, 43, 44, and 45 disposed at about the mid point of each slit 10, 48, 49, and 50, respectively. The slits 10, 48, 49, and 50 are formed to be about twice as long as the actuators 16, 51, 52, and 53 on the slider 15 as shown in FIGS. 8 and 9, and tall enough for the actuators 16, 51, 52, and 53 to easily move back and forth horizontally but with little to no vertical movement.

Referring again FIGS. 5, 6, and 7, on the back bottom of the cassette 7 is a retaining clip 12, which is specifically used for the AK47 style magazine 22, and attaches to the back end of the AK47 style magazine 22. As shown in FIG. 16, the cassette 34, which is designed for the M16 style magazine 36, does not have the retaining clip 12 on it.

Referring again FIGS. 5, 6, and 7, the cassette 7 has two attachment pieces 9 and 41, which comprise a ridged structure to spring back into an original position when inserted into the connectors 5 and 6 on the funnel 1. Attachment pieces 9 and 41, bend backwardly until inserted fully, and the rounded vertical peg end of the attachment pieces 9 and 41 are disposed through the holes within the connectors 5 and 6 to securely fasten the cassette 7 to the funnel 1.

Figure 20:
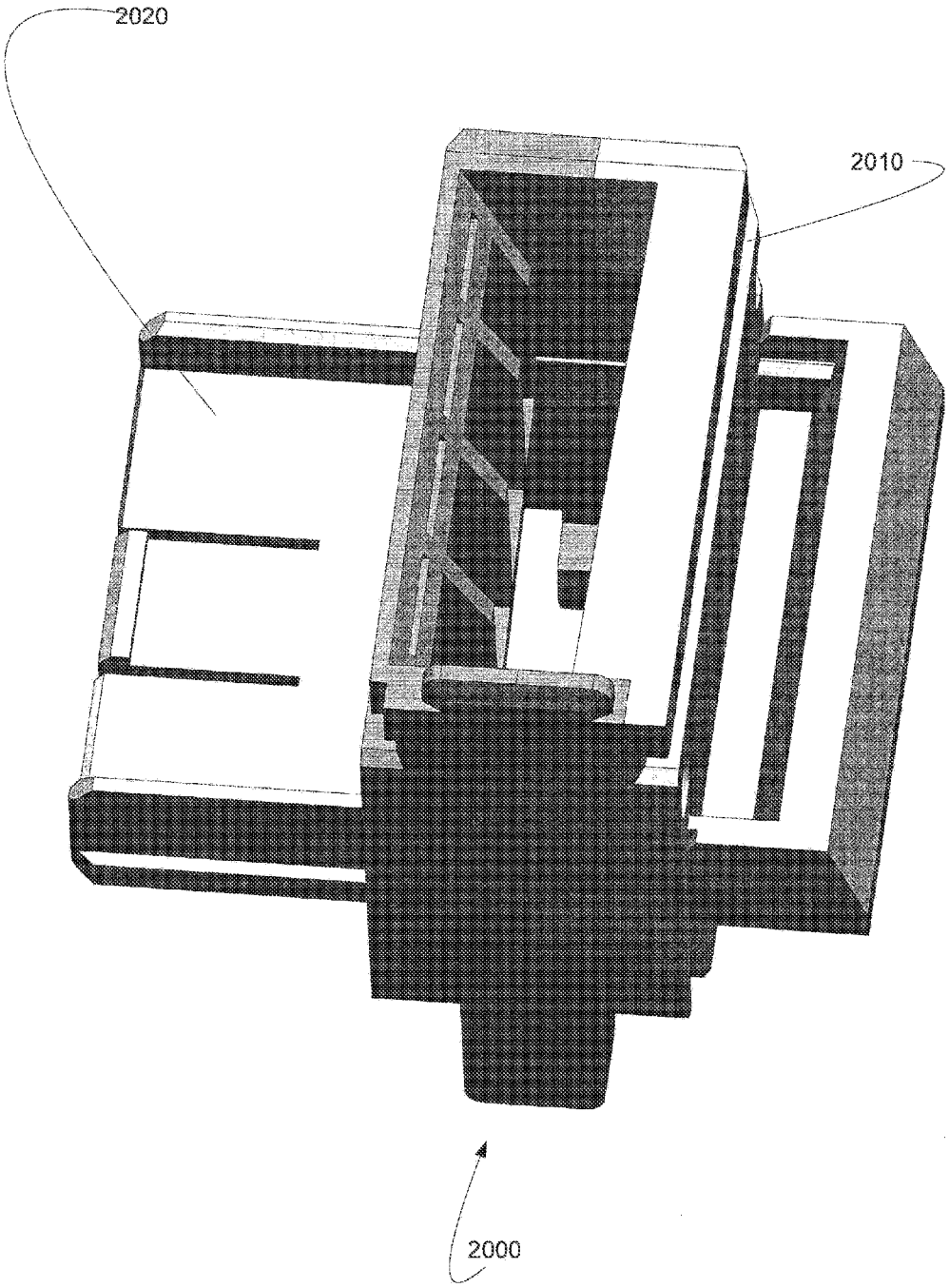
FIG. 20 illustrates a modified version of Applicant's cassette.

Referring now to FIG. 20, cassette 2000 the mechanism that would stop the cartridges from flowing when a magazine was not present or would automatically retract when a magazine was attached was replaced with a slider that has a slot in it. When pushed in, as shown in FIG. 20, the slot lines up with the slot through the center of the cassette and allows the shells to drop through. Then when pulled back the slider portion becomes a blockage that stops the flow of shells through the cassette.

Instead of using the original design of clicking the cassette on from the bottom, cassette 2000 has groves 2010 on the top that aligns with alternate groves on the bottom of the funnel and is slid into position from the front and locked into place.

Referring now to FIGS. 8 and 9, slider 15 is configured such that it is a rectangle with the top and bottom open and one of the short sides removed. In the illustrated embodiment of FIG. 8, slider 15 comprises four actuators 16, 51, 52, and 53. Actuators 16, 51, 52, and 53 are configured such that they are all positioned horizontally, roughly midway down each side and at the same level within the slider 15. In the illustrated embodiment of FIG. 9, each of the actuators 16, 51, 52, and 53 are right angle triangles, with the opposite side of the right triangle closest to the open back side of the slider 15 (in other embodiments the system can be designed such that the actuators 16, 51, 52, 53 can be flipped in the opposite direction).

Figure 10:
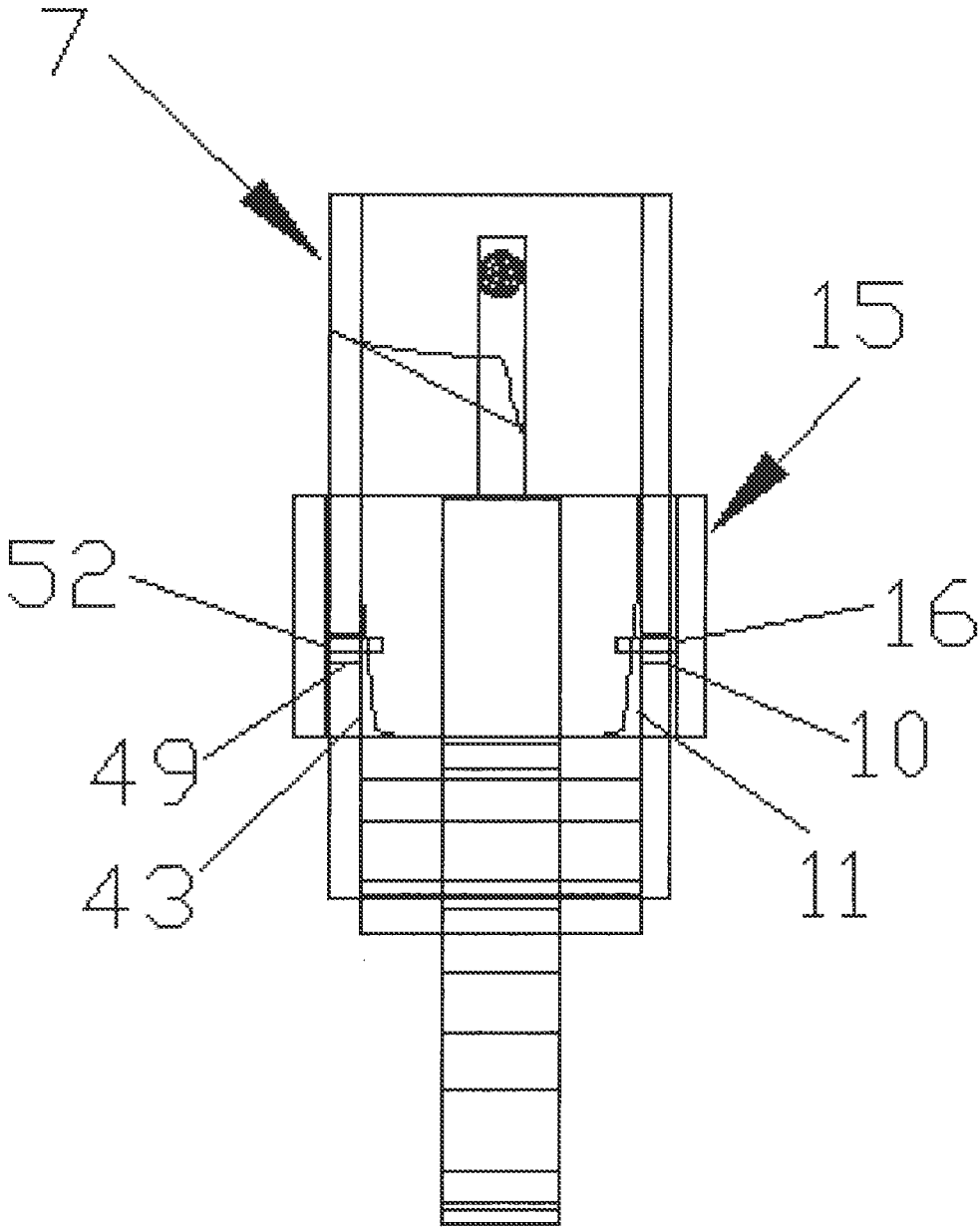
FIG. 10 is a front view of the slider portion of FIG. 8 attached to a cassette portion of FIG. 5, with the slider in an forward open position.

FIG. 10 illustrates cassette 7 and slider 15, with actuators 16 and 52 positioned such that they are inserted into slits 10 and 49, respectively. In the illustrated embodiment of FIG. 10, slider 15 is in its forward position thus allowing the cartridge retainers 11 and 43 to be in fully downward positions, thus allowing the flow of cartridges through the mechanism.

Figure 11:
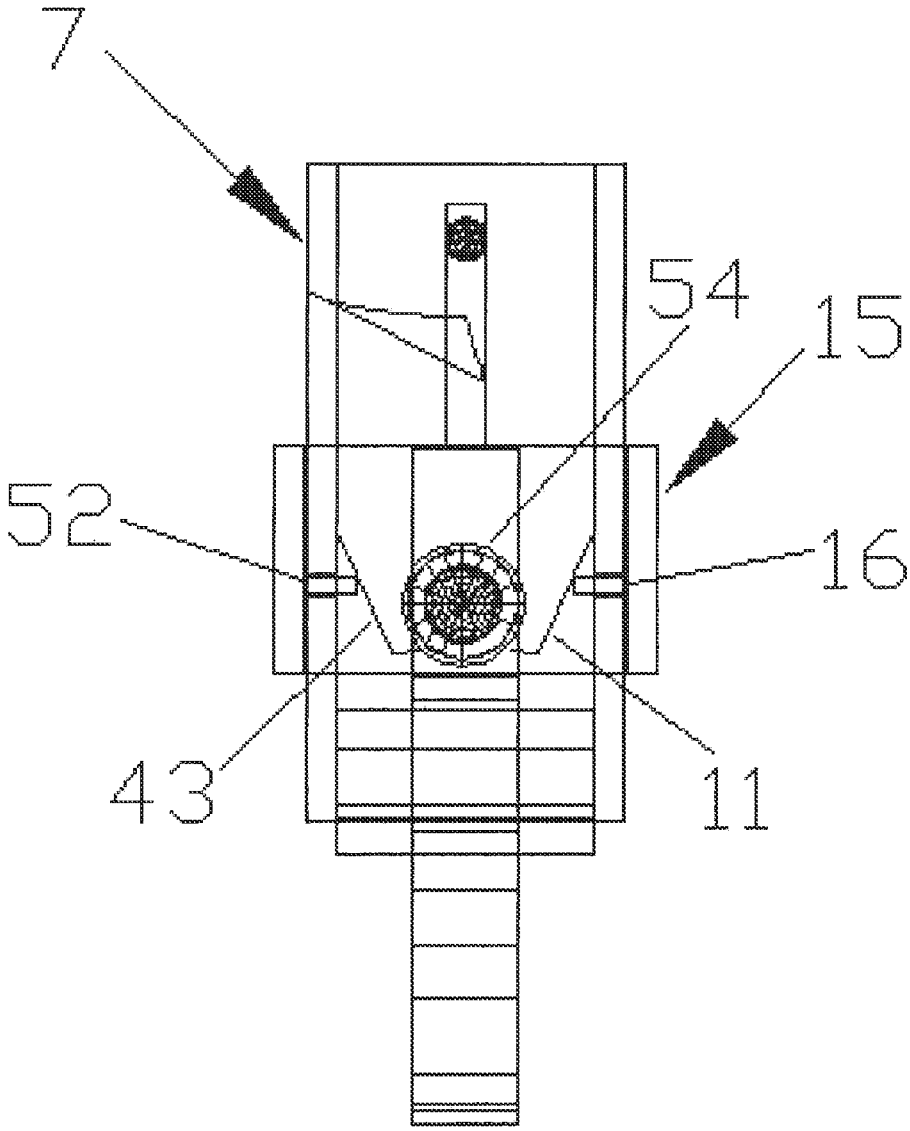
FIG. 11 is a front view of the slider portion of FIG. 8 attached to the cassette portion of FIG. 5 of the present invention, with the slider in a rearward closed position.

FIG. 11 illustrates slider 15 in its pulled back position. In the illustrated embodiment of FIG. 11, the cartridge retainers 11 and 43 are disposed in upward positions, therefore blocking the flow of cartridges 54 through the mechanism.

Figure 12:
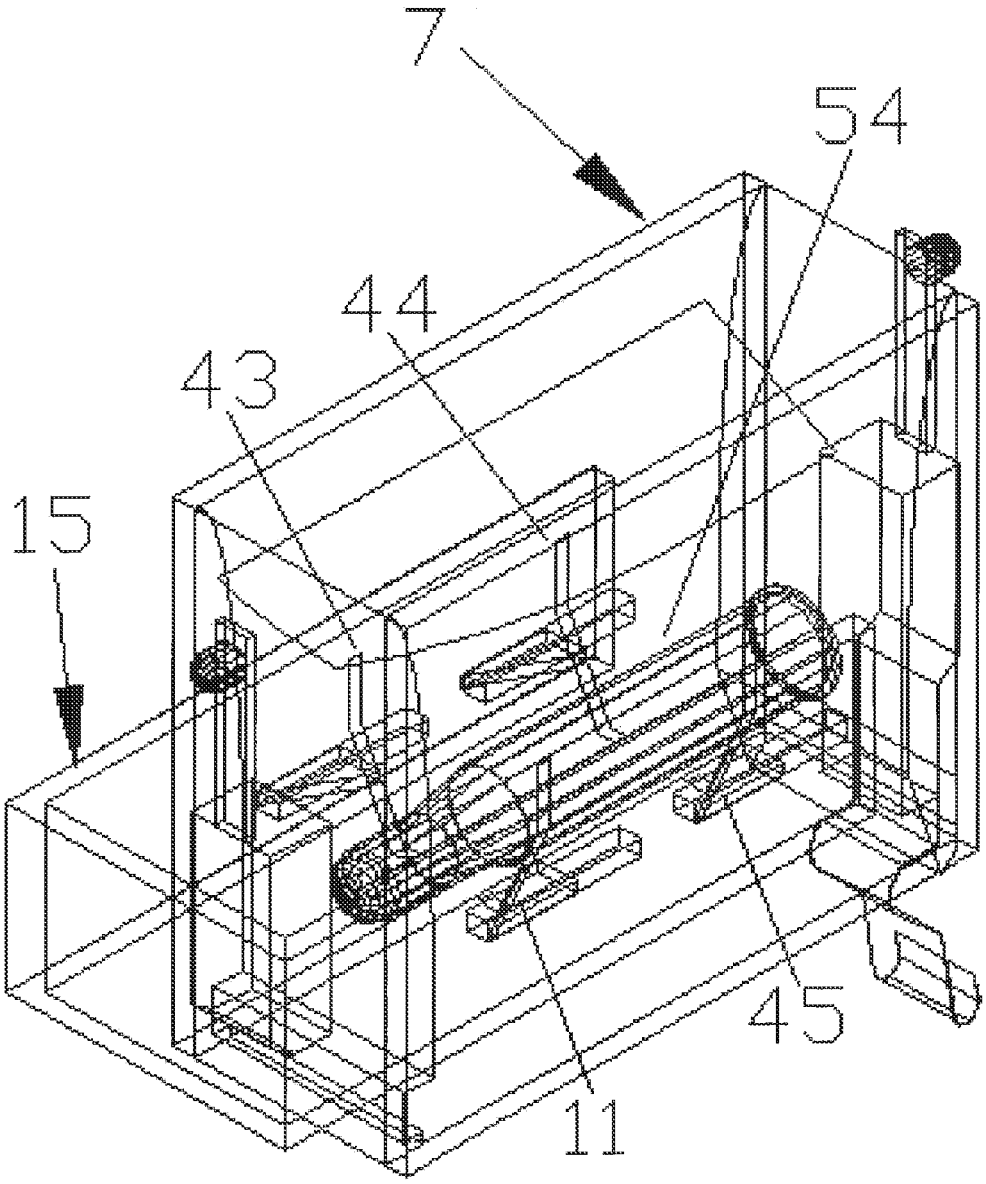
FIG. 12 is a perspective view of the slider portion of FIG. 8 attached to the cassette portion of FIG. 5, with the slider in a rearward closed position.

FIG. 12 shows a perspective view of cassette 7 with a slider 15 in a fully back position. In the illustrated embodiment of FIG. 11, cartridge retainers 11, 43, 44 and 45, are in a fully extended upward positions having been forced forward by their associated actuators 16, 51, 52, and 53, respectively. The cartridge retainers 11, 43, 44, and 45 are shown restricting a cartridge 54 from moving through the cassette 7.

Figure 13:
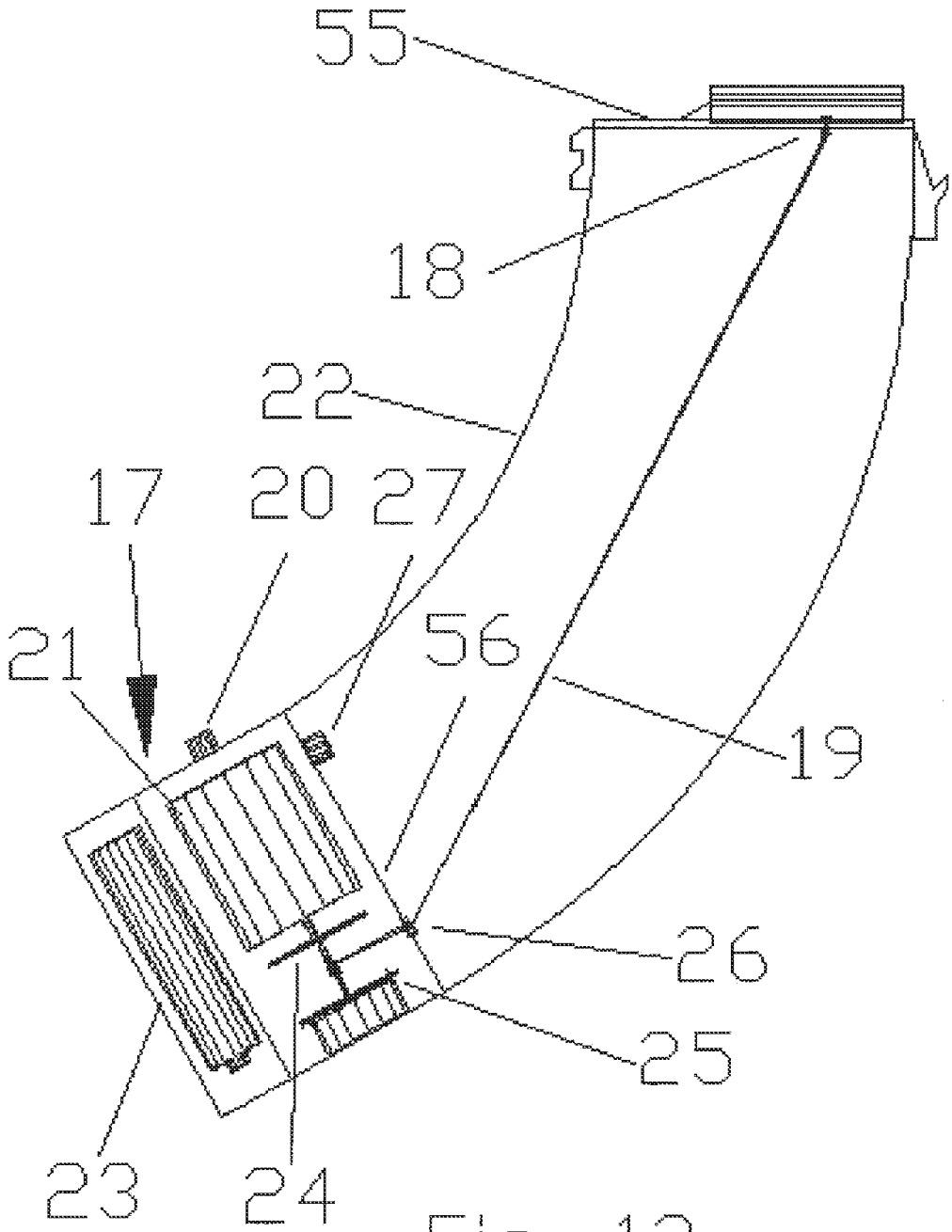
FIG. 13 is a side view of the magazine portion.
Figure 14:
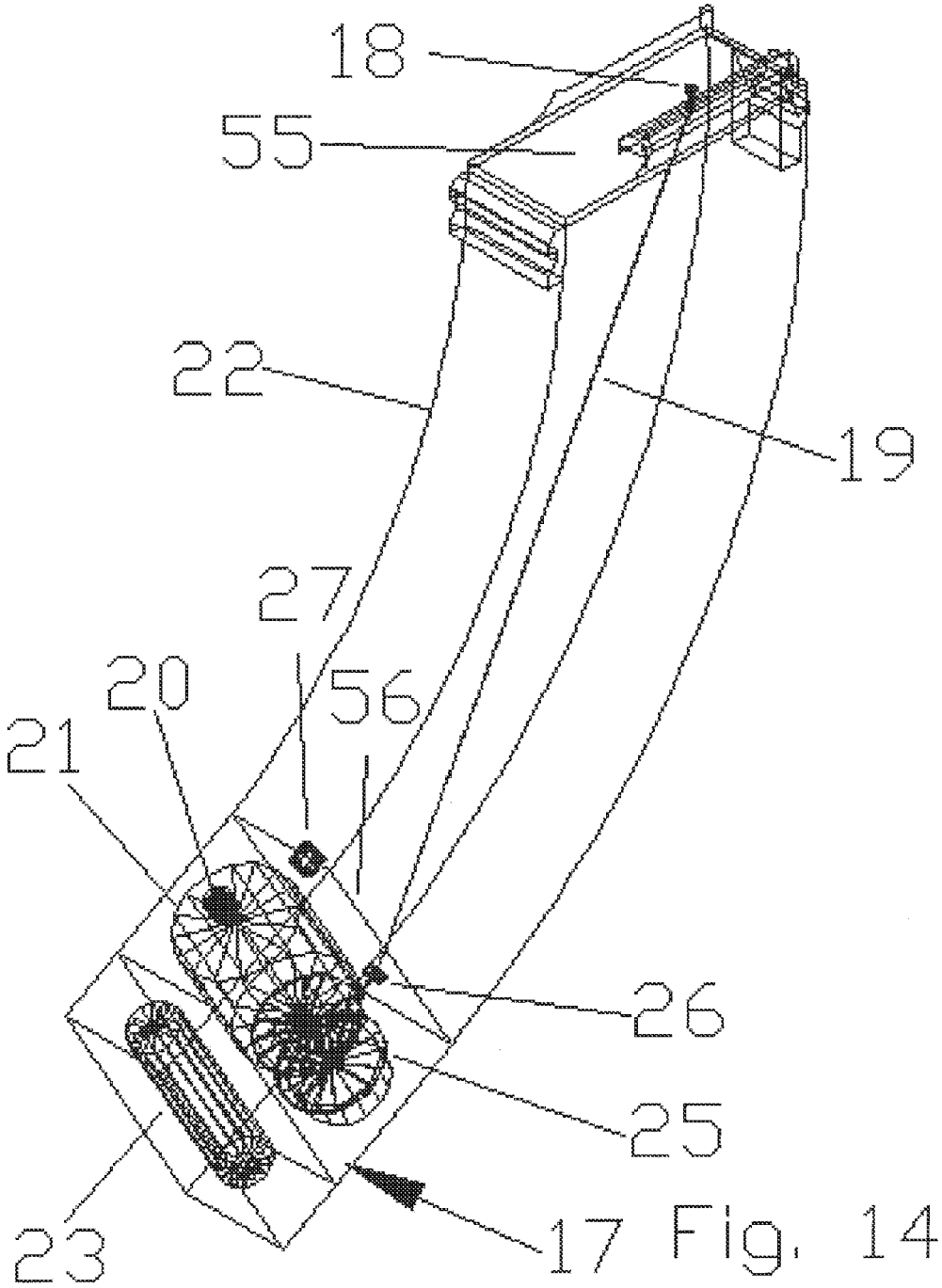
FIG. 14 is a perspective view of the magazine portion of FIG. 13.

Referring now to FIGS. 13 and 14, shows a traditional style AK47 magazine 22. The spring inside the magazine 22 is not shown so as to allow for greater clarity.

The existing carrier plate 55, which sits on top of the magazine spring (not shown) within the magazine 22, is modified to include an attachment pin 18. This attachment pin 18 is placed at such a point that when force is applied to pull it and the earlier plate 55 down, the assembly is balanced and able to move downwardly within the magazine 22. The bottom of the attachment pin 18 is constructed such that it connects to a pull string 19, which is of sufficient strength to not break due to the force of pulling the magazine spring (not shown) down.

Pull string 19 is routed such that it is connected to the attachment pin 18, at its top, and routed down through a grommet 26, and on to a pulley 24. The grommet 26 is installed in a hole that is placed within the existing bottom plate 56 of the magazine 22. The grommet 26 is positioned such that when the carrier plate 55 is fully retracted the attachment pin 18 aligns directly above the grommet 26, so as not to allow the string 19 to bind up.

Retraction assembly 17 is attached to the bottom of the magazine 22. The retraction assembly 17 is constructed to be as wide and deep as the magazine 22, and is as high as is required to house a high torque electric motor 21, a compartment to house a battery 23, and the accompanying equipment to perform its required task.

In certain embodiments, retraction assembly 17 comprises a high torque electric motor 21, which is configured to wind the string 19 onto the pulley 24 while retracting the magazine spring (not shown). On the opposite side of the pulley 24 from the electric motor 21, there is attached a coil spring 25. This spring 25 is used to keep tension on the string 19, after the electric motor 21 shuts off.

A power button 20 allows the user to trigger the electric motor 21 on and off. Additionally there is a cut off switch 27, which like the string 19 runs through the bottom plate 56 of the magazine 22. The cut off switch 27 halts the power to the electric motor 21 when it pulls the carrier plate 55 to the bottom of the magazine 22. Additionally, in the event that the battery no longer functions, the entire retraction assembly 17 can be used as a handle, and thus the carrier plate 55 can be retracted manually, allowing the invention to continue to be used even without electric power. In the event that this option is used the cut off switch 27 acts as an alignment pin for repositioning the retraction assembly 17.

Figure 19:
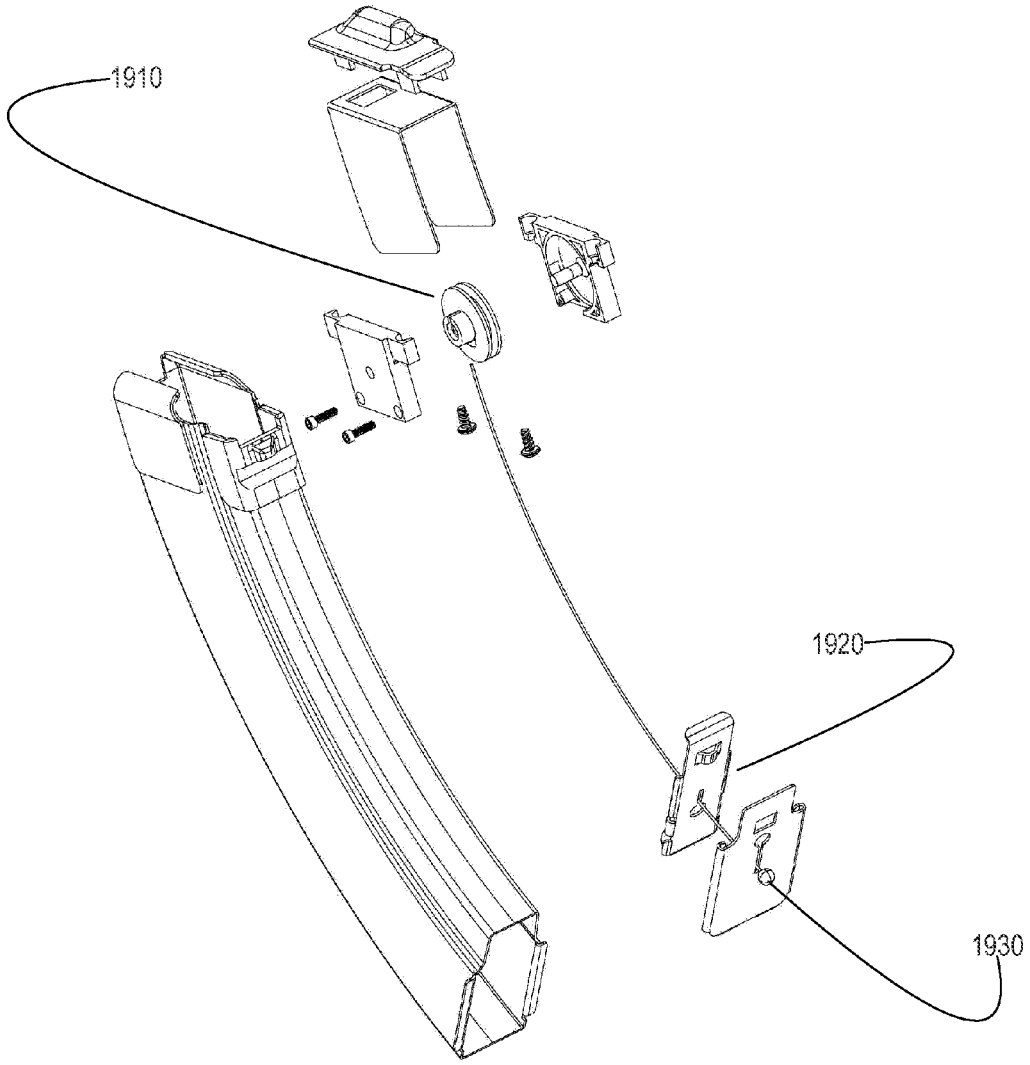
FIG. 19 illustrates a manual version of Applicant's modified magazine.

Referring to FIG. 19, in certain embodiments, the electric motor at the bottom of the magazine is eliminated in favor of a manual version. A retractor mechanism 1910 for the metal pull line is attached under the top plate.

The bottom plate is replaced by interlocking plates 192. These plates are configured such that they have offset aligned holes and slots that allows for a metal nub 1930 at the end of the metal pull line to go through the holes and the line to slide through the slots. The bottom plates then slide onto and lock in place on the existing magazine.

The metal nub at the bottom of the line has a corresponding detachable handle that is used to lock onto the nub and pull the top plate down.

Referring now to FIG. 15, stand 29 comprises a back rod 30, which although shown as a round rod, may be any shape. Near the top of the back rod 30 is a holding fork 31 that crosses the back rod 30 at a 90-degree angle and is centered horizontally on the back rod 30.

Holding fork 30 comprises two arms 57 and 58. In certain embodiments, arms 57 and 58 are adjustable, side to side. The arms 57 and 58 are used with connectors 28, 38, 39, and 40 on the funnel 1. Arms 57 and 58 slide into the connectors 28, 38, 39, and 40, and maintain the positioning of magazine-loading device 37.

Legs 32 and 60 are positioned to hold the stand 29 and the magazine-loading device 37. In certain embodiments, rubberized bump pads 33 and 59 are disposed at the end of each of the legs 32 and 60, respectively. Rubberized bump pads 33 and 59 are used to tap the back of a freshly loaded magazine 22 thereon, and thus seat the cartridges 54 to the back of the magazine to allow for more consistent loading into the chamber of a firearm by the bolt.

The advantages of the present invention include, without limitation, the device allows a person to reload a magazine in only a few seconds as compared to others that may take minutes. This device also allows for even people that may have problems with the dexterity of their fingers or hands to enjoy sport shooting. Further, it is portable and easy to transport. It is easy to move this device into a house, a vehicle, or a shooting range because it is relatively small and lightweight. Moving such devices typically requires a single person, and typically at most two if the device is moved in its constituent parts rather than as a whole.

In broad embodiment, the present invention is a system of a funnel, which can interchangeably connect to existing firearm magazines of different caliber with a motorized or manual addition to the end that pulls down the internals of the magazine and allows for the reloading of cartridges.

Figure 18A:
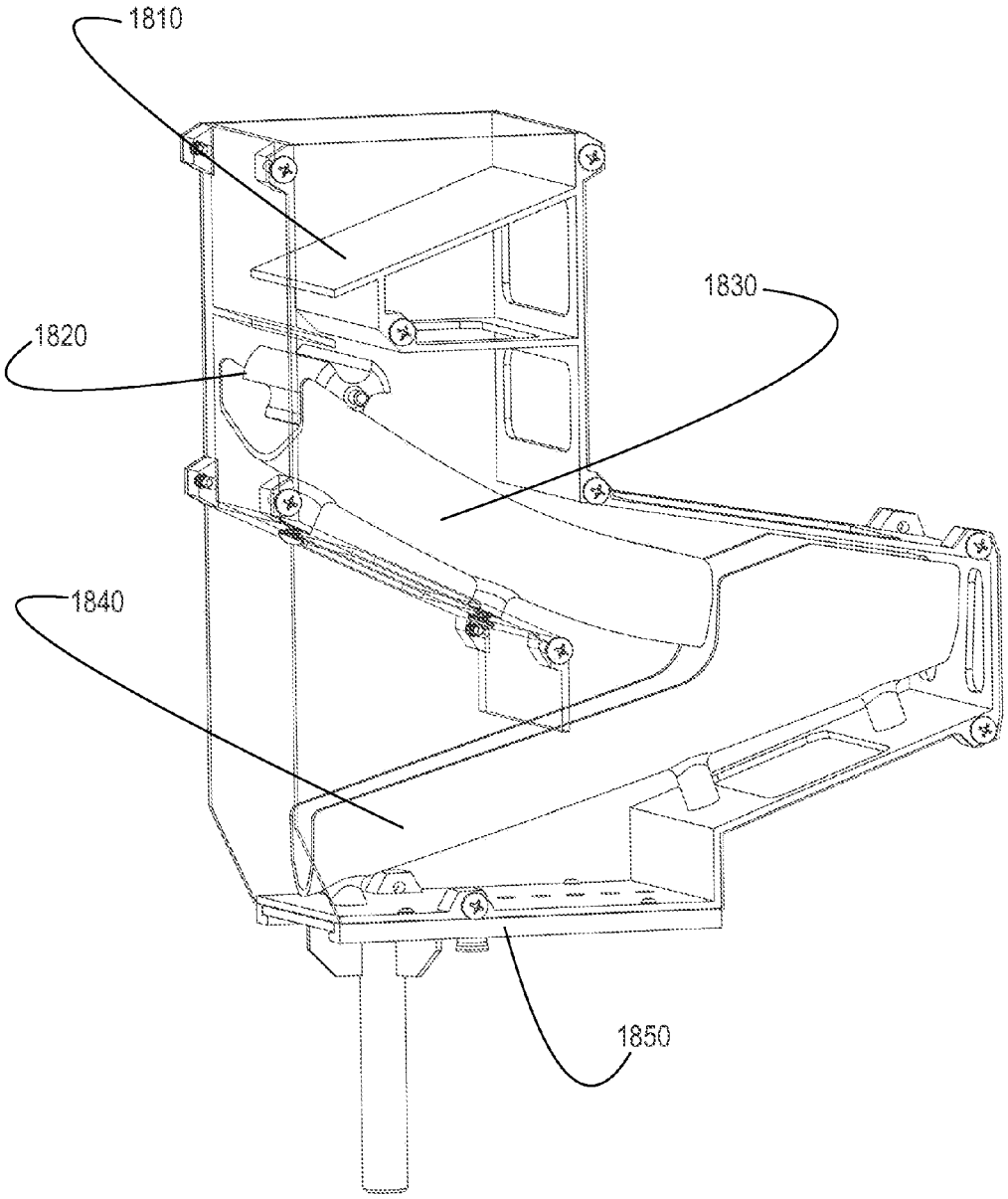
FIG. 18A illustrates Applicant's sorter 1800.
Figure 18B:
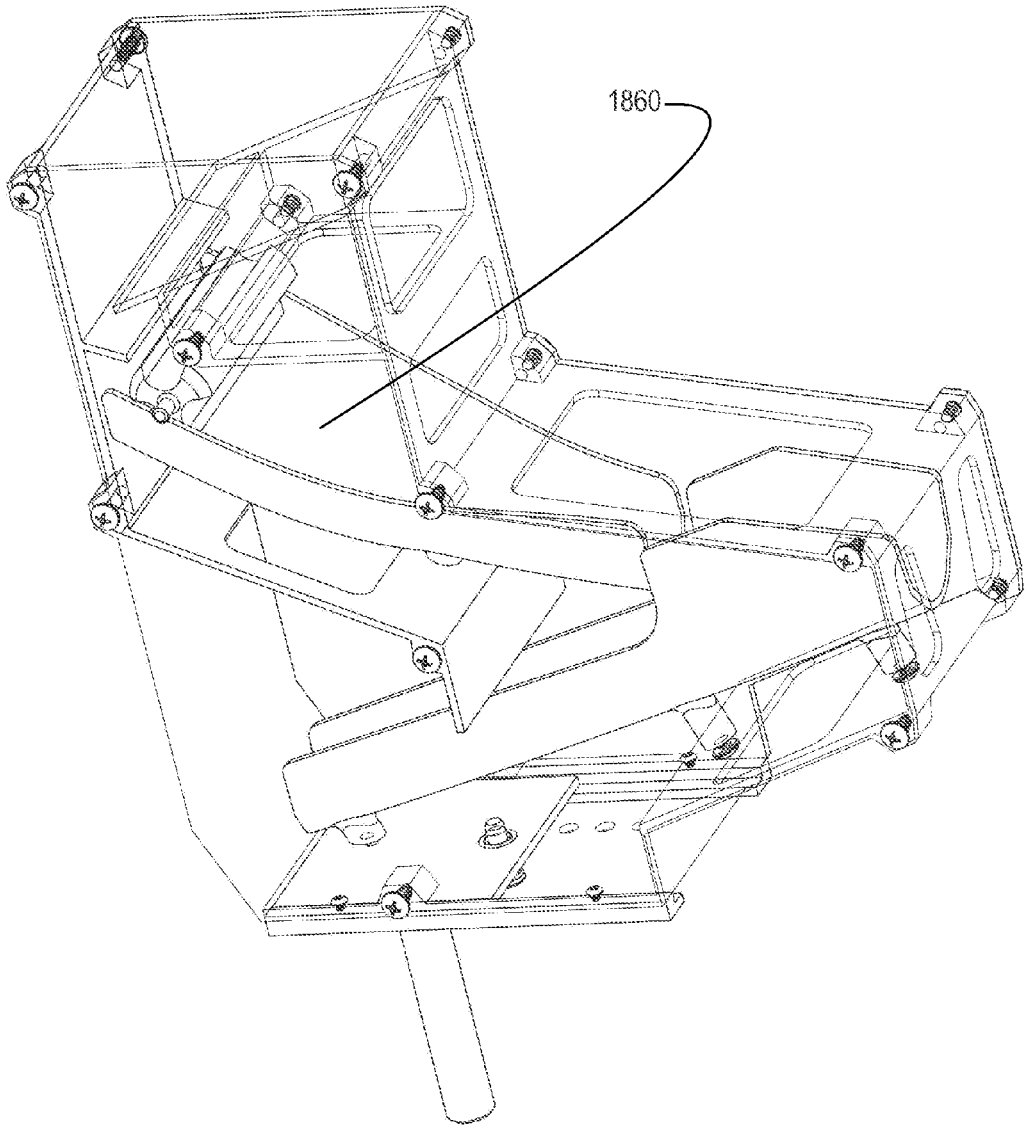
FIG. 18B shows a different perspective of the sort of FIG. 18A.

Referring to FIGS. 18A and 18B, Applicant's alignment mechanism 1800, sometimes referred to as a sorter, is used to automatically align the cartridges such that they will fall into the funnel portion facing the correct way.

Assembly 1800 comprises three slides 1810, 1820, and 1820, a rotator 1820 that only allows one shell at a time to fall through the aligner (this is so two shells will not interfere with one another on the way through), and an adjustment plate 1850 that allows the entire assembly to move back and forth above the funnel and allows for different caliber shells to be used.

Cartridges are dropped one at a time onto slide 1810, where they fall down into the rotator 1820. In certain embodiments, rotator 1820 is operated manually. In certain embodiments, rotator 1820 is operated by a motor. The cartridge then falls onto slide 1830. The top portion of slide 1830 comprises friction plate 1860. Friction plate 1860 comprises a rough surface wherein the heavier tip of the shell is held in place by the force of friction while the cartridge casing spins around to be aligned. The cartridge then continues to slide down to the end of slide 1830.

The end of slide 1830 is formed to include a V or U shape cut to align the cartridges in the event that they go past the friction plate without being aligned correctly. In the event that a heavier bullet end of the cartridge is sliding down first (misaligned), with the V shaped grove the force of gravity pulls the bullet down and makes the shell flip over as it falls down onto slide 1840. If on the other hand the cartridge is properly aligned, with the casing of the cartridge falling down first, the heavier bullet will not allow the cartridge to flip over since it is still being held up on slide 1830, thus it will fall directly onto slide 1840 correctly aligned.

There is also an addition to the bottom of slide 1830 which stops the cartridges from bucking up and accidentally flipping over. From there, whether or not it flipped over from slide 1830 the cartridge will simply slip down slide 1840 and into the funnel portion.

While the preferred embodiments of the present invention have been illustrated in detail, it should be apparent that modifications and adaptations to those embodiments may occur to one skilled in the art without departing from the scope of the present invention as set forth herein.

I claim:

1. An apparatus for loading cartridges into a firearm magazine, comprising:

a funnel portion for intake of one or more cartridges;

a guide box attached to said funnel portion;

a cassette attached to said guide box;

a slider attached to said cassette; and a magazine attached to said slider.

2. The apparatus of claim 1, wherein said guide box is formed to have a tubular structure defining a first interior space and comprising a plurality of fins disposed within said first interior space, wherein said fins are arranged in an alternating pattern within said first interior space.

3. The apparatus of claim 2, wherein:

said guide box further comprises one or more connectors attached to an outside surface thereof; and each of said one or more connectors comprises a square shape formed to include an aperture extending inwardly.

4. The apparatus of claim 1, wherein said cassette comprises:

a rectangular housing formed to include an open top and bottom, wherein said housing defines a channel therethrough;

a fin extending into said channel;

a plurality of cartridge retainers disposed within said channel.

5. The apparatus of claim 4, wherein said cassette further comprises:

a pair of tapered shims disposed within said channel;

wherein the profiles of said tapered shims can be adjusted to guide different caliber cartridges into position.

6. The apparatus of claim 5, wherein said housing is formed to include four slits extending therethrough, wherein each of said four slits is oriented perpendicular to a different cartridge retainer.

7. The apparatus of claim 6, wherein said slider comprises:

a U-shaped frame having a first long side, a second long side, and a short side, wherein said long side is attached to an opposing end of said short side;

wherein said slider is movable disposed on said cassette such that said slider is moveable between a first position and a second position.

8. The apparatus of claim 7, wherein said slider further comprises:

a first plurality of actuators disposed on said first long side and extending inwardly therefrom;

a second plurality of actuators disposed on said second long side and extending inwardly therefrom;

wherein:

when said slider is disposed in said first position none of said actuators extends through a slit formed in said cassette;

when said slider is disposed in said second position each of said actuators extends into and through a slit formed in said cassette.

9. The apparatus of claim 1, wherein said magazine comprises:

a housing comprises a top end and a bottom end;

a magazine spring disposed within said housing;

a carrier plate disposed on a first end of said spring;

an attachment pin 18 disposed on said carrier plate;

a pull spring having a first end and a second end, wherein said first end is attached to said attachment pin.

10. The apparatus of claim 9, further comprising:

a pair of interlocking bottom plates disposed at said bottom end of said magazine, wherein each bottom plate is formed to include an aperture therethrough;

wherein said second end of said pull string passes through each of said pair of interlocking bottom plates and outwardly from said magazine.

11. The apparatus of claim 9, further comprising:

a motor disposed adjacent said bottom end of said housing;

a pulley connected to said motor;

wherein said second end of said pull spring is attached to said pulley.

12. The apparatus of claim 11, further comprising a battery disposed adjacent to said motor and electrically interconnected to said motor.

13. The apparatus of claim 12, further comprising a switch electrically disposed between said battery and said motor.

14. The apparatus of claim 11, further comprising a controller comprising a processor, a non-transitory computer readable medium interconnected with said processor;

wherein said controller is interconnected with said motor by a communication link.

15. The apparatus of claim 14, wherein said controller further comprises:

a Blue Tooth module interconnected with said processor;

a RFID module interconnected with said processor; and a WI-FI module interconnected with said processor.

16. The apparatus of claim 1, further comprising:

an alignment mechanism to automatically align cartridges so that those cartridges will fall into said funnel portion with a desired orientation.

17. The apparatus of claim 16, further comprising:

a housing formed to include an open top;

a first slide having a first end and a second end, and diagonally disposed within said housing such that said first end is adjacent said open top;

a rotator disposed within said housing adjacent said second end of said first slide.

18. The apparatus of claim 17, further comprising:

a second slide having a first end and a second end, and diagonally disposed within said housing such that said first end is disposed beneath said rotator.

19. The apparatus of claim 18, wherein said second slide comprises a friction plate disposed thereon adjacent said first end of said second slide.

20. The apparatus of claim 19, further comprising a third slide having a first end and a second end, and diagonally disposed within said housing such that said first end of said third slide is disposed beneath said second end of said second slide, wherein said second end of said third slide is disposed above a top of said funnel portion.

* * * * *